US006137095A

United States Patent [19]

Kashimoto et al.

[11] Patent Number: 6,137,095

[45] Date of Patent: Oct. 24, 2000

[54] COOKING DEVICE WITH SYSTEM FOR CONTROLLING COOKING OF FOODS

[75] Inventors: Takashi Kashimoto; Koji Yoshino; Yasuo Yoshimura, all of Nara; Hiroyoshi Nomura, Kyoto; Makoto Shibuya, Nara; Shigeo Yoshida, Osaka, all of Japan

[73] Assignee: Matsushita Electric Industrial Co., Ltd., Osaka, Japan

[21] Appl. No.: 09/242,593

[22] PCT Filed: Jun. 18, 1998

[86] PCT No.: PCT/JP98/02716

§ 371 Date: Mar. 22, 1999

§ 102(e) Date: Mar. 22, 1999

[87] PCT Pub. No.: WO98/58210

PCT Pub. Date: Dec. 23, 1998

[30] Foreign Application Priority Data

Jun. 19, 1997 [JP] Japan ..... 9-162251
Feb. 10, 1998 [JP] Japan ..... 10-027964

[51] Int. Cl.[7] ..... H05B 6/66

[52] U.S. Cl. ..... 219/702; 219/678; 219/714; 99/419

[58] Field of Search ..... 219/702, 678, 219/714, 679, 720; 364/131; 340/638, 310.01, 870.02; 99/419, 484

[56] References Cited

U.S. PATENT DOCUMENTS 4,375,586 3/1983 Ueda ..... 219/714
5,272,300 12/1993 Edamura ..... 219/702
5,495,095 2/1996 de Matteis et al. ..... 219/720
5,573,691 11/1996 Yoshida et al. ..... 219/506
5,581,461 12/1996 Coll et al. ..... 705/5
5,724,244 3/1998 Yabuki ..... 705/400
5,774,528 6/1998 Bogner et al. ..... 379/106.01
5,812,393 9/1998 Drucker ..... 364/144
5,875,430 2/1999 Koether ..... 705/1
5,932,130 8/1999 Taino ..... 219/702

FOREIGN PATENT DOCUMENTS 7-145941 6/1995 Japan .
7-198147 8/1995 Japan .
8-272808 10/1996 Japan .
8-292981 11/1996 Japan .
9-18552 1/1997 Japan .
9-27389 1/1997 Japan .
9-60886 3/1997 Japan .
9-152999 6/1997 Japan .

OTHER PUBLICATIONS

Japanese language search report for Int'l Appln. No. PCT/JP98/02716 dated Sep. 29, 1998.

Copy of Form PCT/ISA/210.

*Primary Examiner*—Teresa Walberg
*Assistant Examiner*—Jeffrey Pwu
*Attorney, Agent, or Firm*—Ratner & Prestia

[57] ABSTRACT

A cooking appliance performs cooking which is remotely controlled, based on information relating to the object to be heated, as the information is transmitted to the appliance's computer from a management's computer. The cooking appliance can also cook any part of food in the cooking chamber locally.

31 Claims, 27 Drawing Sheets

COOKING DEVICE WITH SYSTEM FOR CONTROLLING COOKING OF FOODS

This application is a U.S. National Phase Application of PCT International Application PCT/JP98/02716.

FIELD OF THE INVENTION

This invention relates to a cooking appliance for cooking foods. More specifically, this invention relates to a cooking appliance that controls cooking through a communication pathway.

BACKGROUND OF THE INVENTION

A typical cooking appliance of the prior art has a structure as shown in FIG. 1 through FIG. 3.

The cooking appliance utilizes a medium 2 provided with a cooking menu, a material list, a cooking procedure, a cooking time, control information for cooking utensils, nutrient information, cost, and the like as a food information code 1 in a form of characters, voices and images. And, as shown in FIG. 1, the cooking appliance comprises an input means 4 for inputting the food information code 1 into a food information unit 3, a recognition means 5 for discerning the information from the input means 4, a notification means 6 for notifying the information of the recognition means 5, a group of key switches 7 for operating the recognition means 5, and a memory means 8 for storing the food information code 1.

Cooking information is readily and freely obtainable by adding the food information code 1 into the currently available medium 2. The more often the food information code 1 is used, the more useful information it provides to the user (Japanese Patent Laid-Open Publication No. H08-272808).

Another example of a cooking appliance, as shown in FIG. 2, is capable of communicating with an external network.

A microwave oven is shown as an example of the cooking appliance. The cooking appliance 11 consisting of a microwave oven connected with an external management system 10 via a communication pathway 9 comprises: a display means 12 for displaying information in order to discern a cooking recipe such as recipe names, etc.; an operating means 13 to be manipulated for selecting a cooking recipe according to the information displayed on the display means 12; a memory means 14 for storing the information for discerning the cooking recipe such as recipe names, and data relating to the cooking sequence for the recipe; a communication control means 15 for bidirectionally communicating with the external management system 10 via the communication pathway 9; a selection control means 16 operated under a control of the communication control means 15 for reading the information for discerning the cooking recipe stored in the management system 10, displaying it on the display means 12, and transmitting to the management system 10 the cooking recipe selected with a manipulation of the operating means 13; a memory control means 17 operated under control of the selection control means 16 for receiving the information for discerning the selected cooking recipe and the data of cooking sequence for the selected recipe stored in the management system 10, and storing them in the memory means 14; a power supply controller 18; and a cooking unit 19. In order to control the cooking appliance 11, the management system 10 establishes a recipe modification command for the cooking appliance 11, upon recognition of the cooking recipe selected by the cooking appliance 11 through the communication pathway 9. On the other hand, the cooking appliance 11 makes a check of a recipe modification command via the communication pathway 9 upon switching on of power, and it rewrites content of the memory means 14 under control of the memory control means 17, if the command exists. The management system 10 is provided with a cooking recipe management table for storing a file name of character data representing a cooking recipe and the cooking sequence data corresponding to an identification number that is discernible of each cooking recipe among a plurality of the cooking recipes, and an appliance management table for registering identification numbers of the cooking recipes stored in the memory means 14 of each of a plurality of the cooking appliances 11. And the management system 10 transmits to the cooking appliances 11 the character data maintained by the cooking recipe management table, and, at the same time revises a content of the related appliance management table with an identification number of the selected recipe, in response to a control of the selection control means 16 (Japanese Patent Laid-Open Publication No. H09-60886).

Also, a microwave oven shown in FIG. 3 comprises: a cooking cavity divided into a plurality of zones; a plurality of feeding ports 20 capable of selectively supplying energy into each of the zones; a temperature detecting means 21 for detecting temperatures of each zone; an input means 22 for inputting a heating information including a finishing temperature for any of the zones; a determination means 23 for determining a difference between the finishing temperature input by the input means 22 for any of the zones and an actual temperature of the zone detected by the detecting means 21; and a modification means 24 for changing a frequency of selecting the feeding port 20 based on a result of the determination by the determination means 23.

The cooking appliance as described above has been such that the input means 22 employs a pen-input method for designating a specific cooking zone, and the cooking is carried out while temperature of the food is being determined by the determination means 23 as the cooking advances, in order to achieve an optimum result (Japanese Patent Laid-Open Publication No. H07-198147).

The microwave oven of FIG. 2 has had a problem of impairing taste of foods as a result of cooking even if the cooking sequence data is transferred to the cooking appliance 11 via the communication pathway 9, in the case of reheating a box lunch. It is because the microwave oven reheats every food item such as rice, side dishes, salad and pickles contained in the lunch box, even though heating is not desired for the salad and pickles.

Furthermore, a problem of the microwave oven in FIG. 3 has been that it employs a pen-input method for inputting the cooking sequence data so that a user must designate a cooking zone for each of the food items, when for example using it to reheat a box lunch.

According to research conducted, box lunches sold at convenience stores have been modified of their contents at a rate of 30 to 40 times every 2 weeks, and sales of box lunches during a lunch hour period have concentrated within 15 minutes from 12 o'clock. It has taken an average of 35 to 40 seconds to reheat an ordinary box lunch, for example, even with a microwave oven of a regular commercial purpose having an output power of 1400 watts. If a customer requests his box lunch reheated, a store clerk places the box lunch in the microwave oven and selects a button corresponding to the box lunch to start the reheating. It has taken an average of 1 minute and 25 seconds until the box lunch is handed over to the customer after taking it out of the microwave oven and putting it in a bag, including 40 seconds of the reheating time. While it has also included an average of 25 seconds to make a settlement of the payment, it has caused a problem of congestion during crowded times with customers, besides forcing the customer to wait for more than 1 minute. The problem of congestion has even been worsened, when the store clerk has used the pen-input method to designate a specific cooking zone. The problem has occasionally been complicated further due to customers trying to reheat box lunches again, after they have been taken out in the middle of reheating operation in order to avoid the crowdedness with customers, which inevitably leads to less than a desirable heating result.

SUMMARY OF THE INVENTION

A cooking appliance is capable of cooking foods with an appropriate cooking information by a simple manipulation of the user, and/or cooking foods automatically on behalf of the user by an appliance's control means in accordance with the information.

A localized cooking system cooks a desired portion in a cooking chamber selectively with a control means in an appliance control system according to an information related to a food being cooked. This is accomplished by transmitting the information stored in an information storing means of a management system to the appliance control system by a management's communication means.

The appliance to execute a cooking suitable to the food material, since the appliances control system carries out the cooking selectively with the localized cooking system according to a cooking information relative to a food being cooked, a box lunch for example, provided by the management system. It also achieves the cooking within a time far shorter than before, and reduces energy consumption required for the cooking.

The cooking appliance comprises an appliance control system for cooking foods and a management system coupled with the appliance control system via a communication pathway for remotely controlling cooking of the foods in the appliance control system. The appliance control system further comprises: (a) a heating space; (b) a heating means for cooking a food placed in the heating space; (c) a heating progression detecting means for detecting a progress of heating the food; (d) an appliance's reading means for reading an information from the communication pathway; and (e) an appliance's control means for processing the information, and the management system comprises: (f) a managemiient's reading means for reading an information from the communication pathway; and (g) a management's control means for processing the information. When a user of the appliance control system gives a command for heating/cooking the food to the management system, the appliance control system transmits a cooking information providing a control method for the cooking recipe selected by the user as well as an information for the cooking progress to the management system via the communication pathway. And, at the same time, the appliance control system controls the heating means by receiving an information via the communication pathway for remotely controlling the cooking from the management system. Also, the management system transmits to the appliance control system via the communication pathway the remote-control information based on the cooking information and the cooking progress information it receives via the communication pathway. Accordingly, the food is cooked under the remote control of the management system by exchanging the information bidirectionally between the appliance control system and the management system via the communication pathway.

The appliance further comprises: the management system having at least an information storage means for storing information such as the cooking information and the like for the food to be heated, and a management's communication means for communicating the information; the appliance control system having at least an appliance's communication means coupled to the outside, and a control means; and the localized cooking system for cooking a desired portion within the cooking chamber selectively by the control means.

Since the control means provided in the appliance control system selectively cooks the desired portion in the cooking chamber with the localized cooking system, a food to be heated such as a box lunch is cooked distinctively at a material portion that needs a thorough heating from other material portion that averts heating, so as to achieve the cooking in a short period of time.

DESCRIPTION OF THE PREFERRED EMBODIMENTS

First exemplary embodiment

A first exemplary embodiment of the present invention is described hereinafter by referring to a block diagram of FIG. 4.

Figure 1:
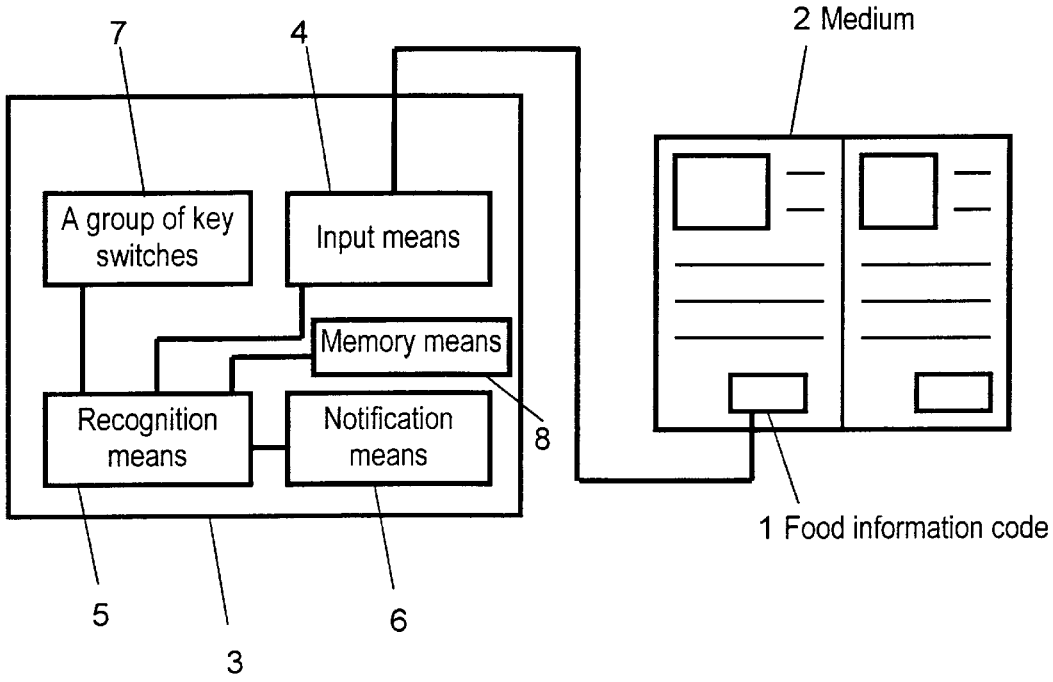
FIG. 1 PRIOR ART
FIG. 1 is a block diagram depicting a configuration of a cooking appliance of the prior art.
Figure 2:
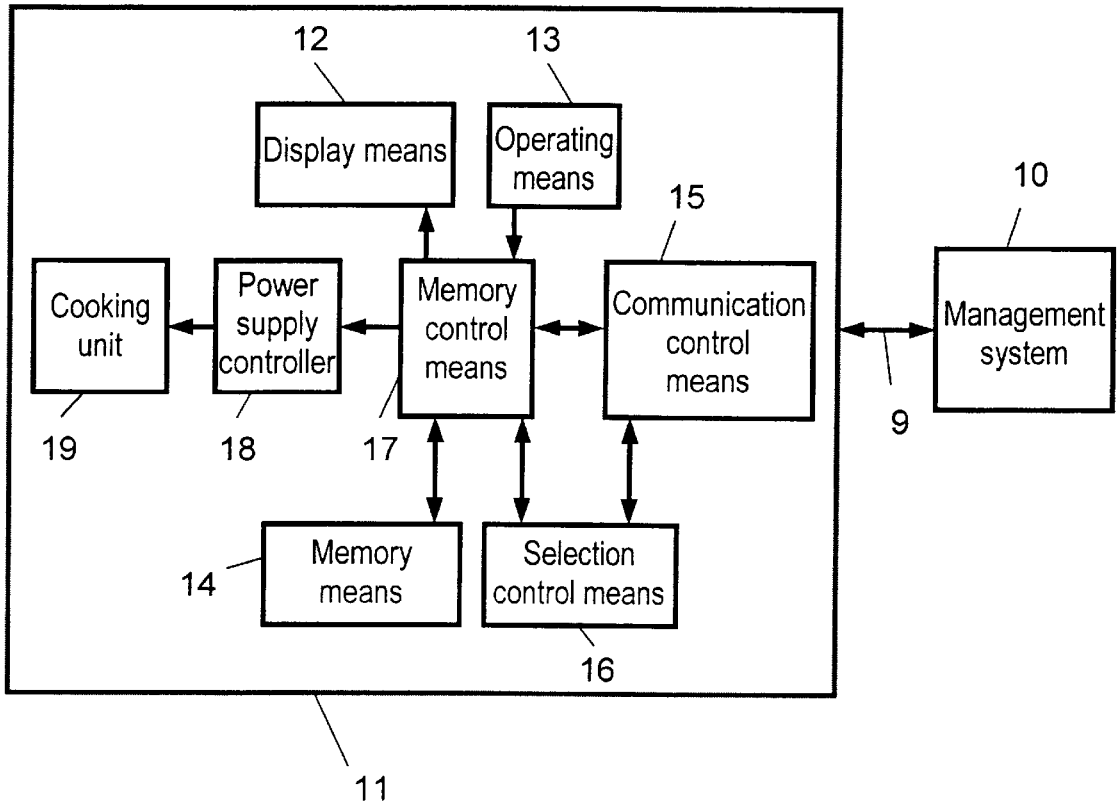
FIG. 2 PRIOR ART
FIG. 2 is a block diagram depicting another cooking appliance of the prior art.
Figure 3:
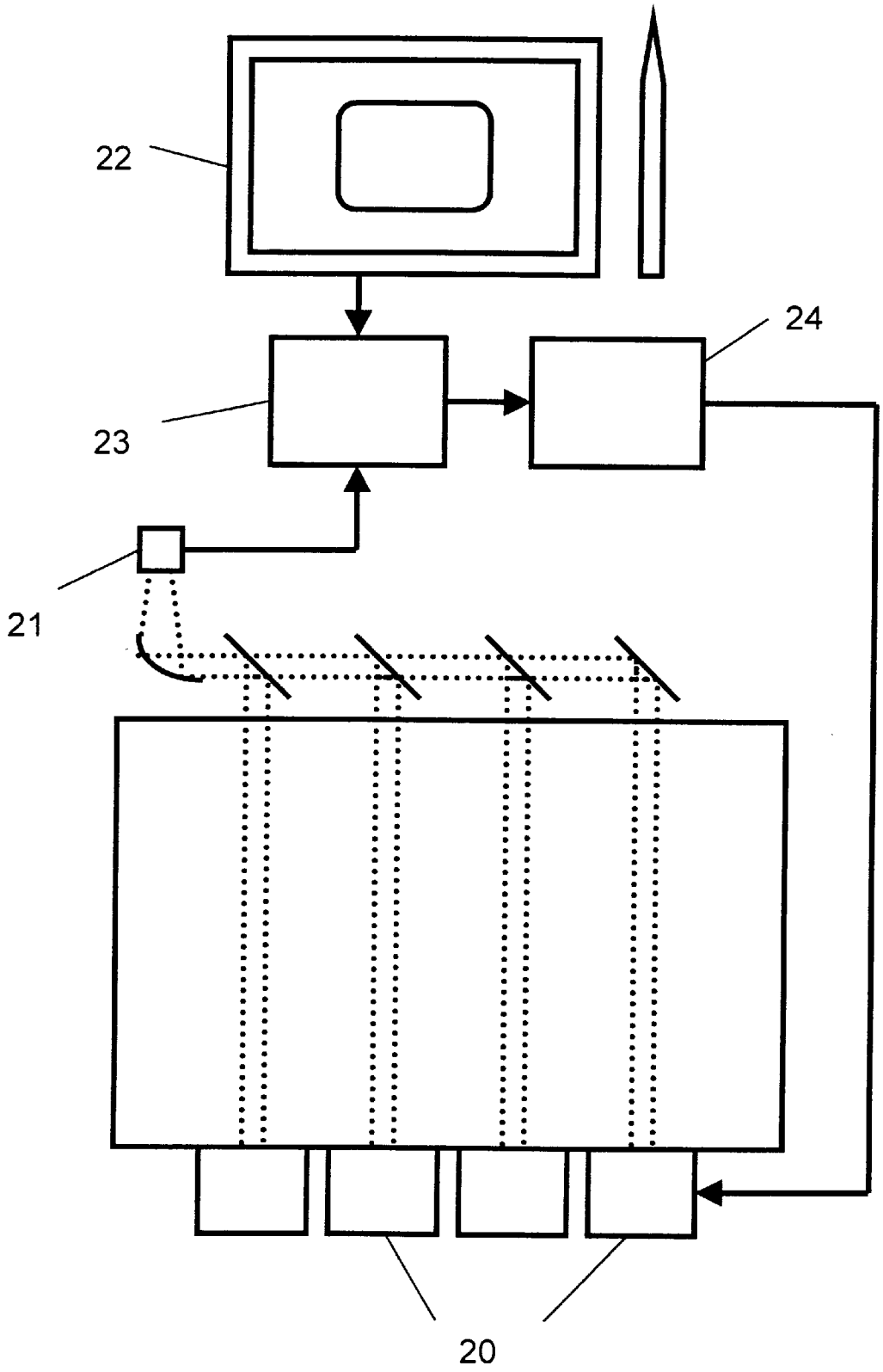
FIG. 3 PRIOR ART
FIG. 3 is a structural diagram depicting still another cooking appliance of the prior art.
Figure 4:
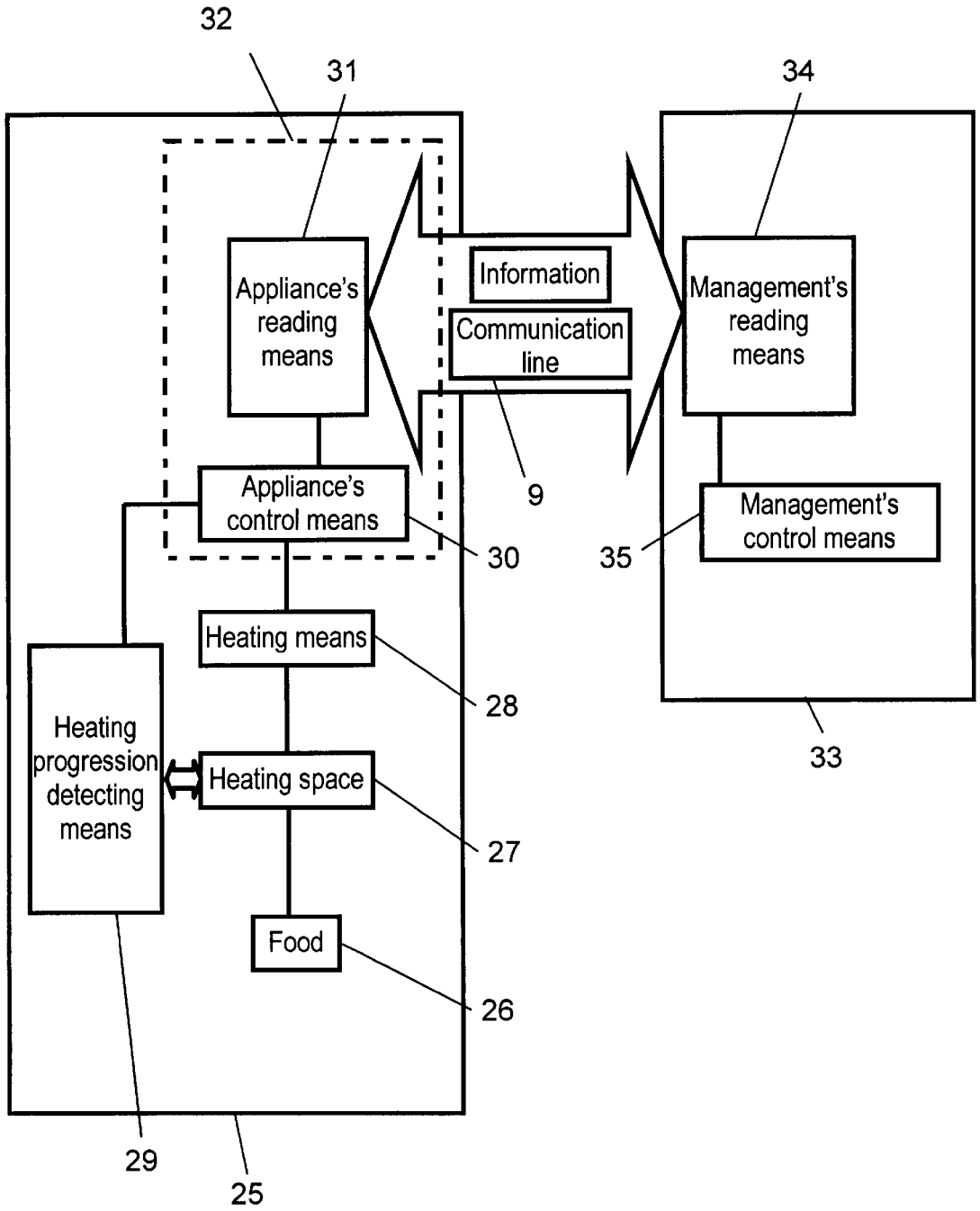
FIG. 4 is a block diagram depicting a configuration of a cooking appliance of a first exemplary embodiment of the present invention.

In FIG. 4, an appliance control system 25 is provided as a part of a cooking appliance (hereinafter referred to as "appliance"). The appliance control system 25 comprises a heating space 27 where a food 26 is placed and cooked, a heating means 28 for cooking the food 26, a heating progression detecting means 29 for detecting a progress of heating the food 26, an appliance's control means 30 for processing an information in the appliance control system 25, and an appliance's reading means 31 for reading the information input through a communication pathway 9. The appliance's control means 30 and the appliance's reading means 31 constitute an appliance controller 32 that controls an entire operation of the appliance control system 25. On the other hand, a management system 33 controls the appliance control system 25, and comprises a management's reading means 34 for reading information input through the communication pathway 9 and a management's control means 35 for processing the information in the management system 33. In addition, the appliance control system 25 is provided with an input means (not shown in the figure) such as a keyboard or a mouse for a user to input a cooking recipe and the like, e.g. "so and so material for such and such cooking", and it outputs to the appliance's control means 30 an information corresponding to the input given by the user.

An operation and function are described next. In the appliance control system 25, the food 26 is placed in the heating space 27 such as a cooking chamber where the food is cooked by confining high frequency waves, in the case of a microwave oven as an example, and the heating means 28 cooks the food 26 under the control of the appliance's control means 30. During this process, the heating progression detecting means 29 keeps detecting a physical change of the food 26. The heating progression detecting means 29 detects a change in moisture generated by the food 26 being cooked, a change in humidity, a weight of the food, a temperature of the food, etc. It also detects a distribution of electric fields in the heating space 27, a variation in power supply voltage, a temperature of the appliance control system 25, a temperature in the heating space 27, etc. in the case of a microwave oven. This information during progress of the heating are fed into the appliance's control means 30.

If the user is well acquainted with an operating procedure of the appliance control system 25, he sets a cooking recipe corresponding to the food 26 by manipulating the input means in a predetermined manner. The where outputs the cooking recipe to the appliance's control means 30. The appliance's control means 30 is provided with a control method for each of the cooking recipes as a cooking information for controlling the heating and cooking, so that it cooks the food 26 in the heating space 27 by controlling the heating means 28 in response to the cooking information corresponding to the input cooking recipe and the heating progress information detected by the heating progression detecting means 29.

If the user is not well acquainted with an operating procedure of the appliance control system 25, he presses a help key (not shown in the figure) provided in the input means. This causes the appliance's control means 30 to access the management system 33 via the appliance's reading means 31 and the communication pathway 9 such as an optical fiber cable or the like, and gives the management's control means 35 charge of the control through the management's reading means 34. Then the appliance control system 25 transmits cooking information corresponding to the cooking recipe and the heating progress information to the management system 33 via the communication pathway 9. In the management system 33, the management's reading means 34 reads the cooking information and the heating progress information fed in via the communication pathway 9, and outputs them to the management's control means 35. The management's control means 35 transmits remote-control information to the appliance control system 25 via the communication pathway 9, and controls it based on this information in order to properly cook the food 26 in the heating space 27. During this process, the appliance control system 25 continuously transmits the heating progress information to the management system 33 via the communication pathway 9, since the heating condition changes every moment as the cooking progresses.

As has been described, the present embodiment is capable of bidirectionally exchanging between the appliance control system 25 and the management system 33 via the communication pathway 9, the cooking information such as the cooking recipe and the cooking condition, the heating progress information and the remote-control information. This enables the appliance control system 25 to carry out the cooking easily and appropriately by remotely controlling the appliance control system 25 with the management system 33 in a manner to finish the food 26 properly, even though the user has no knowledge of the cooking and/or a way to operate.

Second exemplary embodiment

Figure 5:
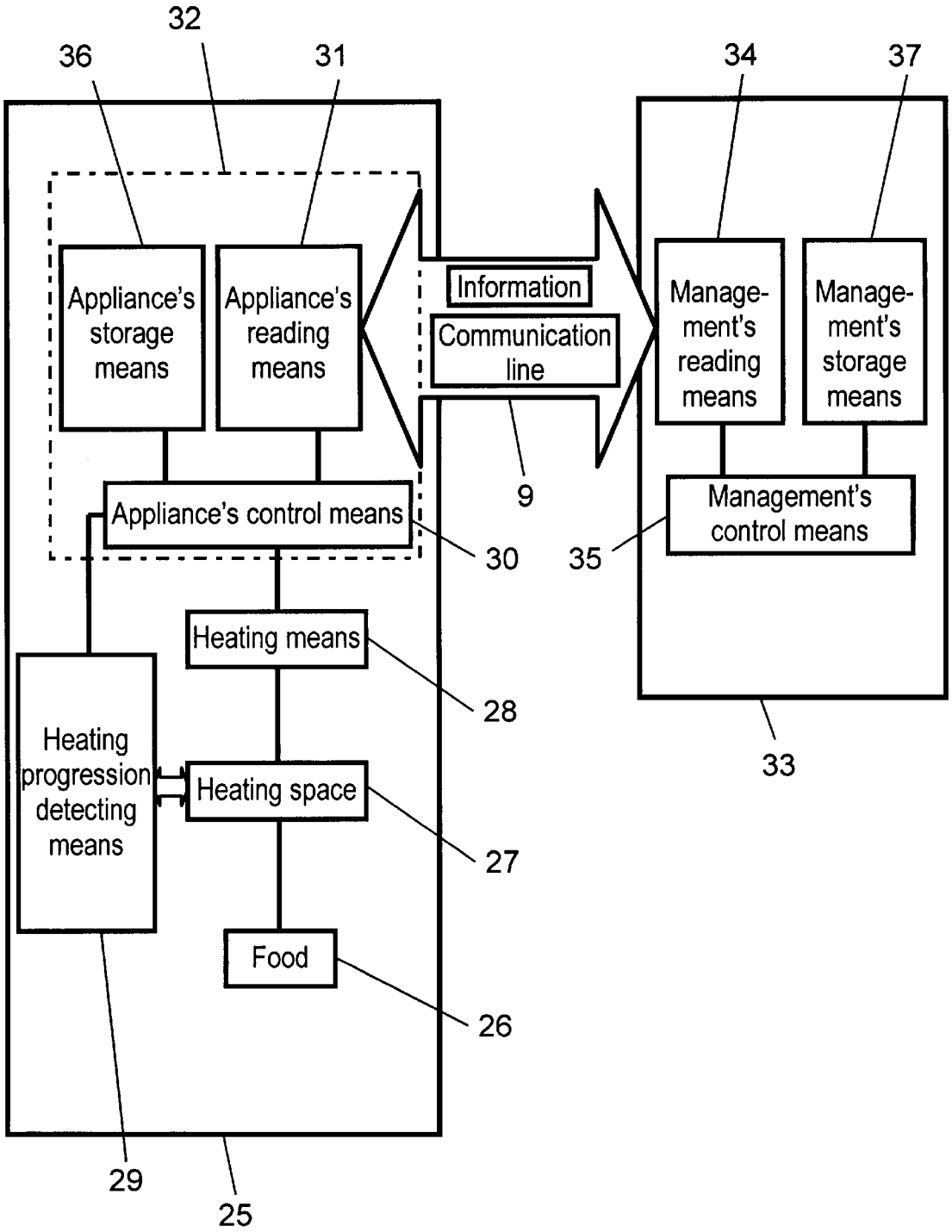
FIG. 5 is a block diagram depicting a configuration of a cooking appliance of a second exemplary embodiment of the present invention.

A second exemplary embodiment is described hereinafter by referring to a block diagram of FIG. 5.

Any components having the same structure as the first exemplary embodiment depicted in FIG. 4 are assigned with the same reference numerals and the detailed descriptions are omitted. The present embodiment differs from the first exemplary embodiment in that the appliance controller 32 is provided with an appliance's storage means 36, and the management system 33 is provided with a management's information storage means 37, so that the appliance's storage means 36 stores the information received from the management system 33, and the management's information storage means 37 stores the information received from the appliance control system 25. In general, a magnetic storage means such as a magnetic disc memory or a nonvolatile storage means such as a semiconductor memory are useful for the appliance's storage means 36 and the management's information storage means 37.

An operation and function are described as follows. In the appliance control system 25, the appliance's control means 30 feeds and cumulatively stores in the appliance's storage means 36 the information it receives from the management system 33. Also, in the management system 33, the management's control means 35 feeds and cumulatively stores in the managemenit's information storage means 37 the information it receives from the appliance control system 25, In this way, the control system 25 accumulates and stores the information such as new cooking recipes, etc. received from the management system 33 into the appliance's storage means 36. Also, the management system 33 accumulates and stores the information such as the cooking recipes, heating progress, etc. received from the appliance control system 25 into the management's information storage means 37. Other operations are omitted, as they are same as those of the first exemplary embodiment.

With the present embodiment as described above, a provision of the appliance's storage means 36 in the appliance controller 32 enables it to additionally store the new cooking recipes by accumulating the information received from the management system 33. And, a provision of the management's information storage means 37 in the management system 33 enables supervisory personnel of the management system 33 to reflect a utilization factor of the cooking recipes and the heating condition in the appliance control system into a development of new recipes by accumulating the information received from the appliance control system 25.

It should be noted that the information to be stored by the appliance's storage means 36 and the management's information storage means 37 are not limited to the foregoing, but they are adaptable according to a predetermined specifications set between the appliance control system 25 and the management system 33.

Third exemplary embodiment

Figure 6:
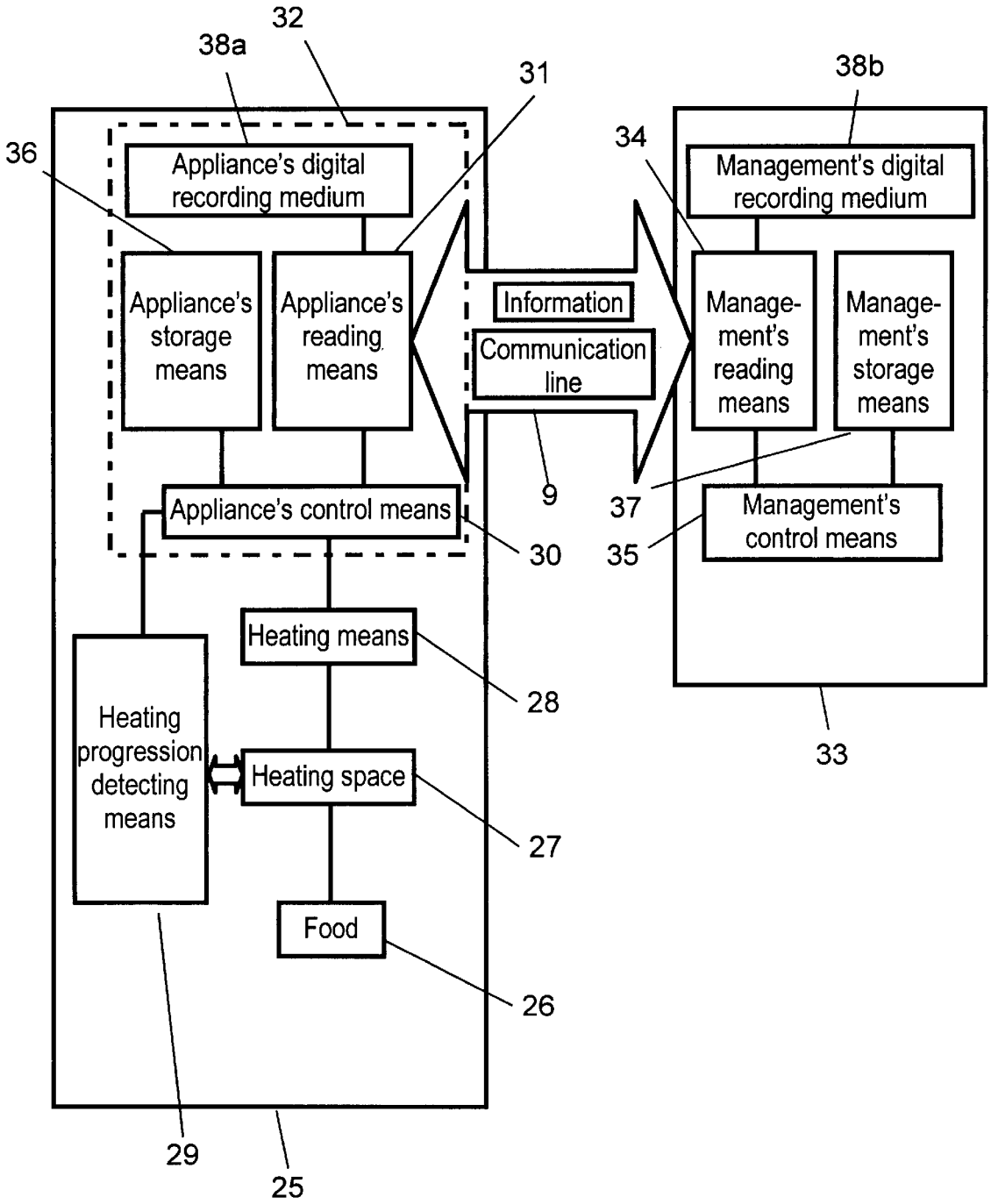
FIG. 6 is a block diagram depicting a configuration of a cooking appliance of a third exemplary embodiment of the present invention.

A third exemplary embodiment is described hereinafter by referring to a block diagram of FIG. 6.

Any components having the same structure as the first and the second exemplary embodiments are assigned with the same reference numerals and the detailed descriptions are omitted. The third embodiment differs from the first and the second exemplary embodiments in that the appliance control system 25 is provided with an appliance's digital recording medium 38*a* in the appliance controller 32, and the management system 33 is provided with a management' digital recording medium 38*b*. Both of the recording media are prepared in advance with storage of a vast volume of information. A floppy disc, a compact disc or barcodes for recording information by digital signals are some of the examples of recording media utilized for the appliance's digital recording medium 38*a* and the management' digital recording medium 38*b*.

Although the appliance control system 25 in the first exemplary embodiment is provided with the cooking information corresponding to the cooking recipe that the user inputs, it desirably stores numerous cooking information beforehand in order to respond to a great variety of the cooking recipes. The management system 33 also needs to store beforehand the cooking information corresponding to a great variety of new cooking recipes. The appliance's digital recording medium 38*a* and the management' digital recording medium 38*b* of the third exemplary embodiment furnishes these information readily.

An operation and function are described as follows. In the appliance control system 25, when the user inputs a cooking recipe, the appliance's control means 30 reads a cooking information corresponding to the cooking recipe input by the user among the numerous cooking information recorded beforehand in the appliance's digital recording medium 38*a*. Accordingly, the user can readily obtain the cooking information corresponding to a variety of cooking recipes, even if the input means has a limited number of keys, or even if the cooking recipes are numerous. Then the appliance's control means 30 transmits the cooking information and heating progress information to the management system 33 via the appliance's reading means 31 and the communication pathway 9.

In the management system 33, the management's reading means 34 reads the cooking information and the heating progress information fed in via the communication pathway 9, and outputs them to the management's control means 35. The management's control means 35 transmits to the appliance control system 25 via the communication pathway 9 an operational information in order to properly cook the food 26, based on the input cooking information and the heating progress information. Also, since the management' digital recording medium 38*b* retains new cooking recipes and related cooking information recorded in it in advance, it transmits the new cooking recipe to the appliance control system 25 by making a predetermined process for getting access to it through the management system 33. The appliance control system 25 then records the new cooking recipe it receives in the appliance's storage means 36.

If the appliance control system 25 requires cooking with the new cooking recipe, it reads out an information of the new cooking recipe stored in the appliance's storage means 36, and sends it to the management system 33 by accessing to it. The management system 33 inputs a heating progress information from the appliance control system 25 according to the request, and sends an operational information to the appliance control system 25 in order to cook the food 26 properly based on the cooking information stored in the management' digital recording medium 38*b* and the cooking information input to it.

The management system 33 may send the cooking information along with a name of the new cooking recipe to the appliance control system 25, so that the appliance control system 25 can store both of the name of the new cooking recipe and the cooking information in the appliance's storage means 36. Although the appliance's storage means 36 requires a large storage capacity in such instance, it can cook the new cooking recipe by itself, as a matter of course.

As has been described, the present embodiment is able to provide with the cooking information corresponding to a variety of cooking recipes input through the input means, by providing the appliance controller 32 with the appliance's digital recording medium 38*a* for storing in advance a numerous cooking information corresponding to the cooking recipes. Also, by providing the management system 33 with the management' digital recording medium 38*b* for storing in advance new cooking recipes and their cooking information, it is able to forward them to the appliance control system 25 and serve for remotely controlling a cooking of the recipes.

Fourth exemplary embodiment

Figure 7:
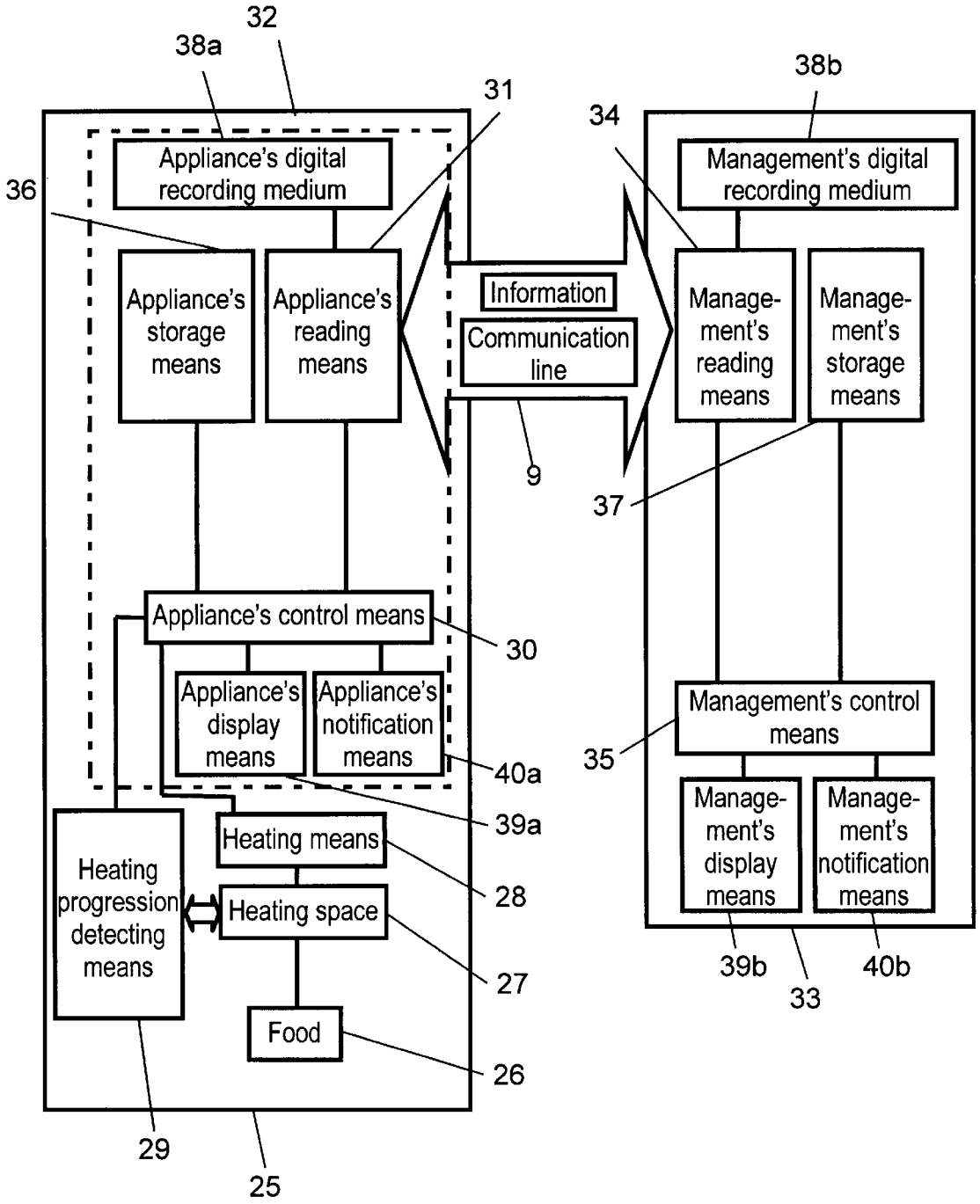
FIG. 7 is a block diagram depicting a configuration of a cooking appliance of a fourth exemplary embodiment of the present invention.

A fourth exemplary embodiment is described hereinafter by referring to a block diagram of FIG. 7. Any components having the same structure as the first through the third exemplary embodiments are assigned with the same reference numerals and the detailed descriptions are omitted. The fourth embodiment differs from the third exemplary embodiment in that the appliance controller 32 is provided with an appliance's display means 39*a* for displaying a cooking recipe and heating progress, and an appliance's notification means 40*a* for the similar purpose. Also, the management system 33 is provided similarly with a management' display means 39*b* and a management' notification means 40*b*. In general, a display device employing a liquid crystal display or a small cathode-ray tube can be utilized for the appliance's display means 39*a* and the management's display means 39*b*, and a sound generating device for providing a sound by voice synthesis can be used for the appliance's notification means 40*a* and the management' notification means 40*b*.

An operation and function are described as follows. In the appliance control system 25, the appliance's control means 30 causes the appliance's display means 39*a* to display on it an ongoing cooking recipe and the progress of heating. Also, it announces the user with a sound or a voice by the appliance's notification means 40*a*, if a predetermined condition of abnormalities occurs. In the management system 33, on the other hand, the management' control means 35 causes the management's display means 39*b* to display on it the ongoing cooking recipe and the progress of heating. And it announces to supervisory personnel with a sound or a voice by the management's notification means 40*b*, if a predetermined condition of abnormalities occurs. Therefore, the user can verify the cooking recipe he has set, as well as a progress of the heating, so as to wipe out an uncertainty with regard to the cooking, especially when it is carried out automatically with the remote control. The supervisory personnel can also verify whether the appliance control system 25 that he manages is functioning properly or not, in the management system, so as to ease the operation.

With the fourth exemplary embodiment as described above, the user of the appliance control system 25 and the supervisory personnel of the management system 33 can verify respective ongoing situations and easily know without uncertainties whether or not there is any abnormalities thus carrying out the cooking properly, since the ongoing cooking recipe and the cooking progress are displayed and announced by providing the appliance controller 32 with the appliance's display means 39*a* and the appliance's notification means 40*a*, and the management system 33 with the management' display means 39*b* and the management' notification means 40*b*. Incidentally, the appliance controller 32 may be provided with either one of the appliance's display means 39*a* and the appliance's notification means 40*a*. The same is true with the management system 33. Also, the appliance's display means 39*a*, the appliance's notification means 40*a*, the management' display means 39*b* and the management' notification means 40*b* may be used for the purpose of communication other than the remote control between the appliance control system 25 and the management system 33.

Fifth exemplary embodiment

Figure 8:
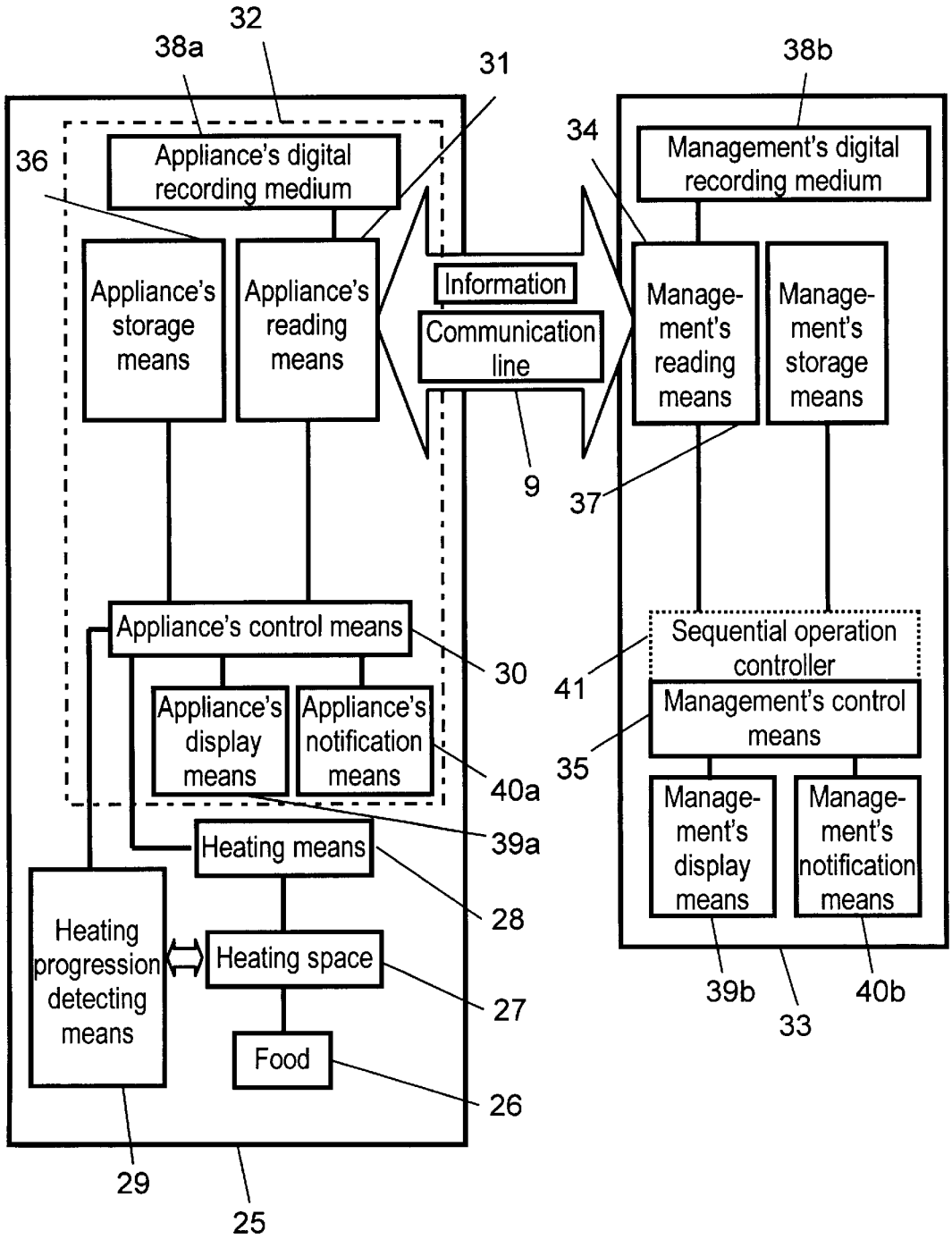
FIG. 8 is a block diagram depicting a configuration of a cooking appliance of a fifth exemplary embodiment of the present invention.

A fifth exemplary embodiment is described hereinafter by referring to a block diagram of FIG. 8. Any components having the same structure as the first through the fourth exemplary embodiments are assigned with the same reference numerals and the detailed descriptions are omitted. The fifth embodiment differs from the fourth exemplary embodiment in that the management system 33 is provided with a sequential operation controller 41 in order to execute the remote control consecutively in response to requirements set from time to time by the user with the appliance control system 25.

An operation and function are described as follows. If the user wants the management system 33 to carry out the cooking automatically with the remote control, he places a command to the management system 33 by setting a requirement such as a cooking condition each time during the cooking, and the sequential operation controller 41 in the management system 33 establishes a remote control information corresponding to individual requirement and transmits it to the appliance control system 25. The user can place each setting with the input means. Therefore, the management system 33 is able to remotely control by taking into account the cooking condition that the user sets each time according to his choice.

With the present embodiment as described above, the management system 33 is able to execute the cooking with a remote control by taking into account the cooking condition that the user sets each time according to his taste, since the management system 33 is provided with the sequential operation controller 41, so as to remotely controls consecutively in response to the cooking condition, etc. set from time to time by the user of the appliance control system during the remote-control cooking.

Sixth exemplary embodiment

Figure 9:
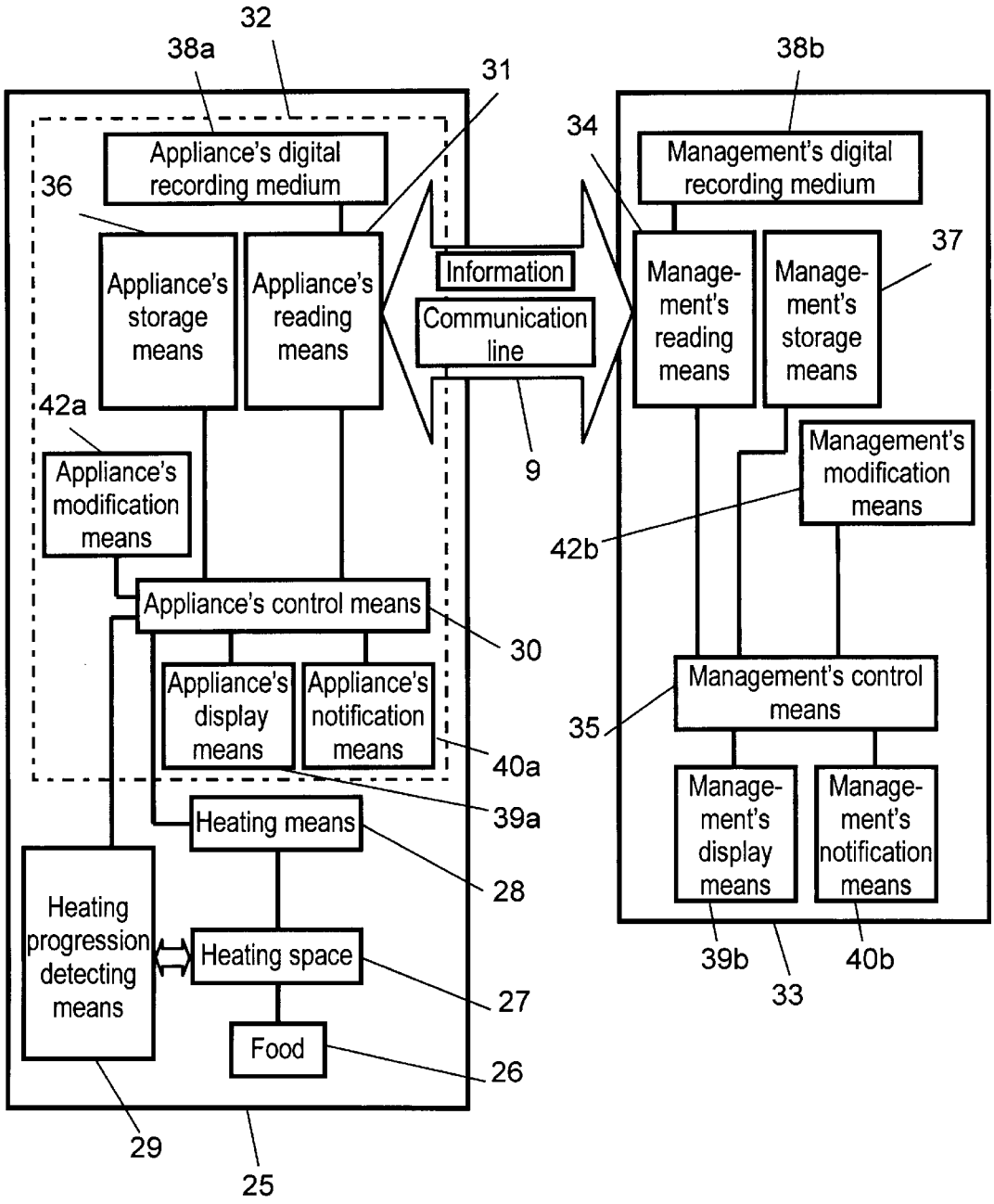
FIG. 9 is a block diagram depicting a configuration of a cooking appliance of a sixth exemplary embodiment of the present invention.

A sixth exemplary embodiment is described hereinafter by referring to a block diagram of FIG. 9. Any components having the same structure as the first through the fifth exemplary embodiments are assigned with the same reference numerals and the detailed descriptions are omitted. The sixth embodiment differs from the fifth exemplary embodiment in that the appliance controller 32 is provided with an appliance's modification means 42*a*, and the management system 33 is provided with a management's modification means 42*b*, thereby enabling an interruption, a restarting, an alteration of cooking time, and the like by cutting in and modifying a series of the control corresponding to the originally established cooking information.

An operation and function are described as follows. When the user lets the management system 33 to carry out the cooking automatically, the cooking progresses according to the cooking information corresponding to the cooking recipe that the user inputs. If the user desires to check the progress of the food or to taste it by interrupting the cooking, he inputs a command of interruption with the input means. The appliance's control means 30 determines it as an interruption by a cut-in, and sends a cut-in information to the management system so as to switch it as well as itself into a cut-in process mode. The operation starts at this point by a modified information, i.e. an interrupting information, of the appliance's modification means 42*a,* and the management's control means 35 interrupts the operation of the heating means 28 according to the interrupting information and continues the interruption. When the user inputs a command for restarting, the appliance's modification means 42*a* terminates the interruption, cancels the cut-in process of the appliance's control means 30 and the management's control means 35, and resumes the series of control before the interruption. The modified information of the appliance's modification means 42*a* is also output to the management's modification means 42*b* during the above cut-in process. With the operation as described above, the user can check the food 26 during the foregoing interrupting period. The user can also modify the cooking time.

Accordingly, the sixth exemplary embodiment enables the user to interrupt and restart the cooking and modify the cooking time, since the appliance controller 32 is provided with an appliance's modification means 42*a,* and the management system 33 is provided with a management's modification means 42*b,* so as to enable a modification of the initially established series of the control by cutting in to it.

Seventh exemplary embodiment

Figure 10:
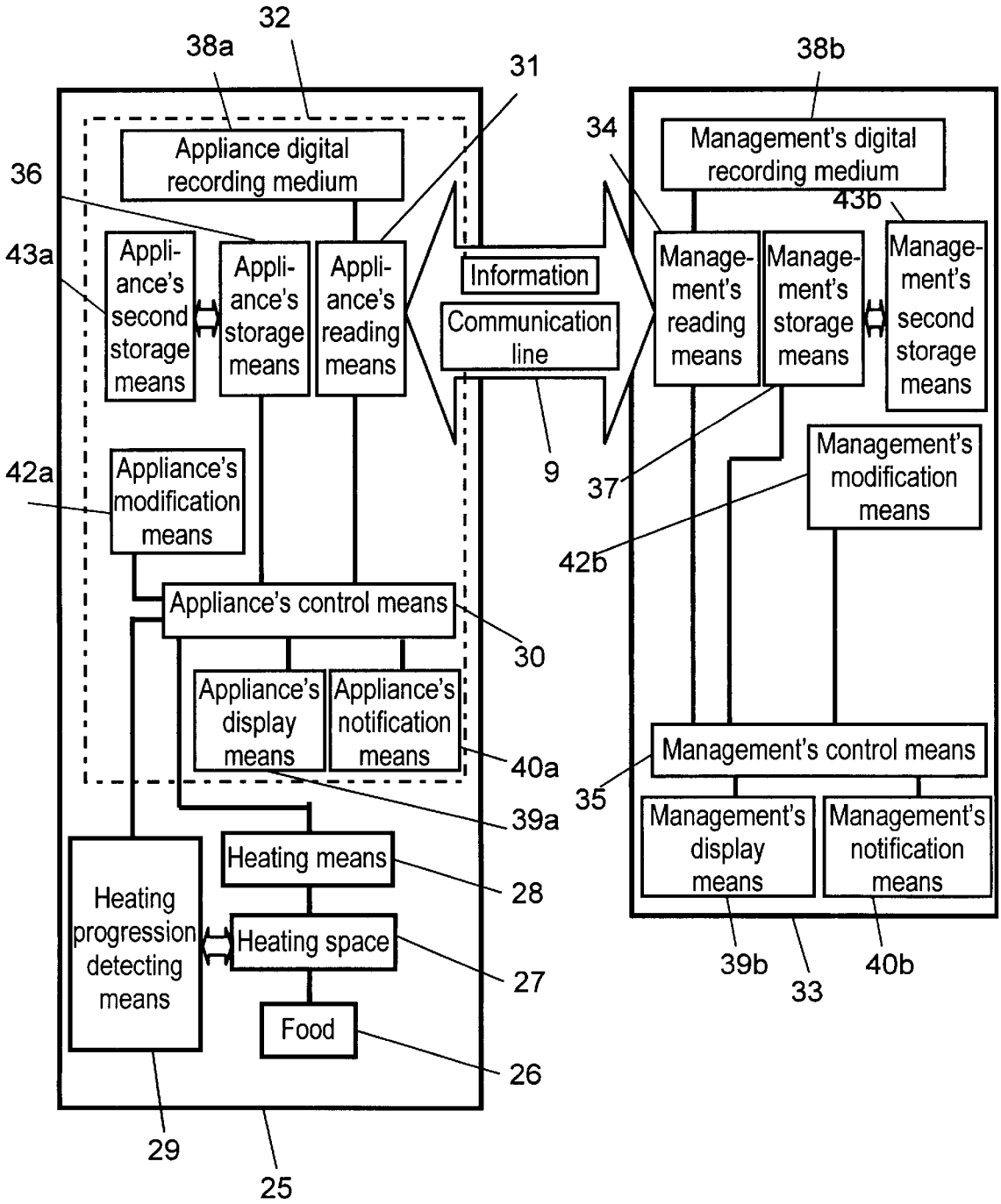
FIG. 10 is a block diagram depicting a configuration of a cooking appliance of a seventh exemplary embodiment of the present invention.

A seventh exemplary embodiment is described hereinafter by referring to a block diagram of FIG. 10. Any components having the same structure as the first through the sixth exemplary embodiments are assigned with the same reference numerals and the detailed descriptions are omitted. The seventh embodiment differs from the sixth exemplary embodiment in that the appliance controller 32 is provided with an appliance's second storage means 43*a,* and the management system 33 is provided with a management's second storage means 43*b*. The modified information altered by the appliance's modification means 42*a* is cumulatively stored in the appliance's second storage means 43*a,* and the modified information altered by the management's modification means 42*b* is cumulatively stored in the management's second storage means 43*b,* so as to make them reusable.

An operation and function are described as follows. The user feeds and stores the cooking information altered by the appliance's modification means 42*a* in the appliance's second storage means 43*a*. When the user places a command requesting the same modification as before, the appliance's control means 30 executes a modified operation by a cut-in using the modified information stored in the appliance's second storage means 43*a*. It is therefore effective in the case that the user repeats an interruption and restarting of the cooking many times.

As has been described, the present embodiment enables the appliance control system 25 and the management system 33 to use the modified information repeatedly, as they are cumulatively stored by providing the appliance controller 32 with the appliance's second storage means 43*a,* and the management system 33 with the management's second storage means 43*b*. Accordingly, the modified information are freely utilized at any time when repeating an interruption and restarting of the cooking. Also, the information altered by the user can be stored cumulatively in the management system 33.

Eighth exemplary embodiment

Figure 11:
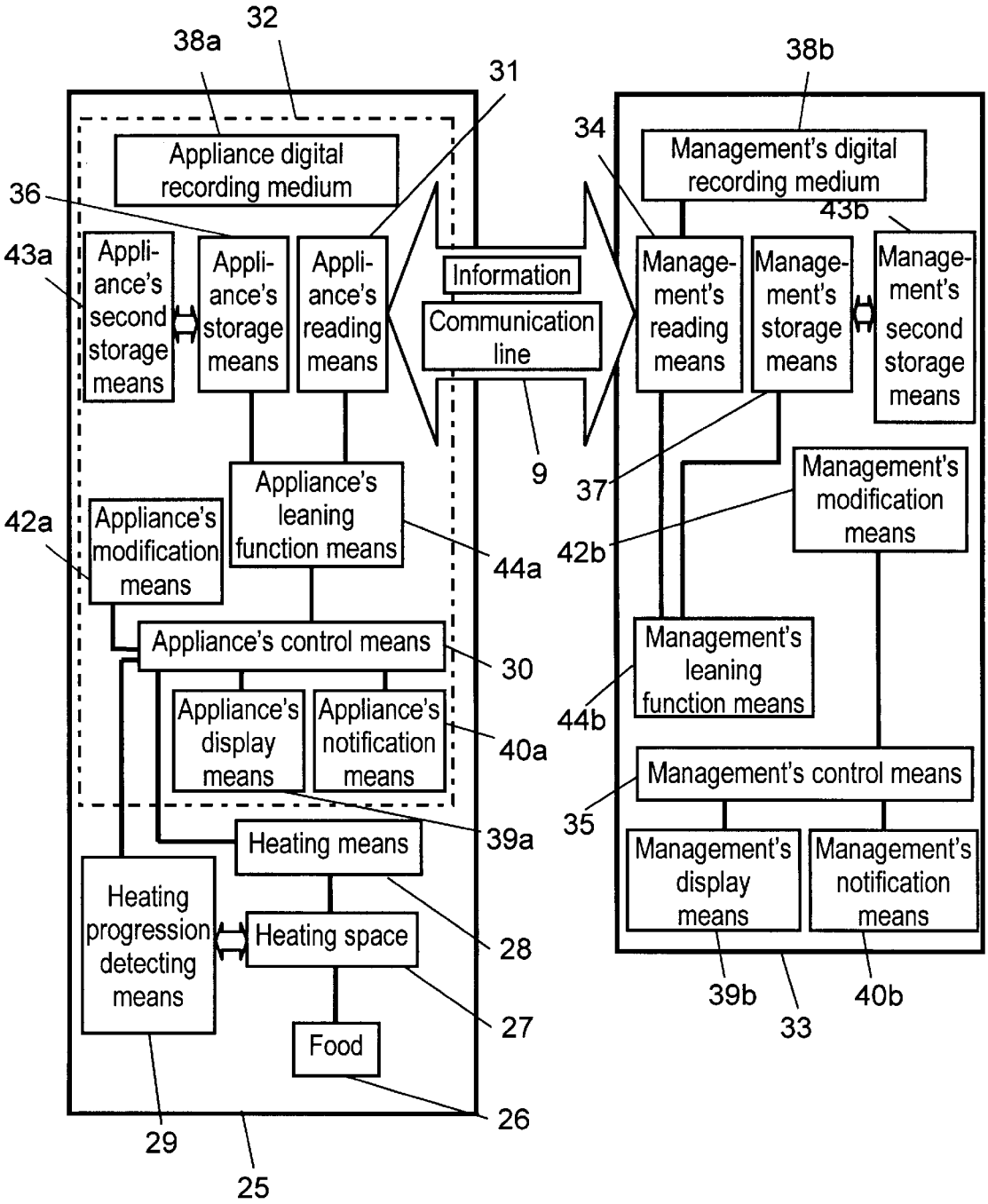
FIG. 11 is a block diagram depicting a configuration of a cooking appliance of an eighth exemplary embodiment of the present invention.

An eighth exemplary embodiment is described hereinafter by referring to a block diagram of FIG. 11. Any components having the same structure as the first through the seventh exemplary embodiments are assigned with the same reference numerals and the detailed descriptions are omitted. The eighth embodiment differs from the seventh exemplary embodiment in that the appliance controller 32 is provided with an appliance's learning function means 44*a,* and the management system 33 is provided with a managemiienit's learning function means 44*b,* so that the user can further improve the cooking information for storage.

An operation and function are described as follows, for the appliance control system 25, at first. New cooking information received from the management system is stored in the appliance's storage means 36. The modified information of which process has been altered with the appliance's modification means 42*a* by the user is stored in the appliance's second storage means 43*a*. The more the information is preferred by the user, the higher a frequency of the use will be, since the user tends to use it more often than others. The appliance's learning function means 44*a* adds a preferable modified information corresponding to the preferable cooking information among the modified information stored in the appliance's second storage means 43*a,* to the preferable cooking information among the cooking information stored in the appliance's storage means 36, based on the frequency of use of the information stored in the appliance's storage means 36 and the appliance's second storage means 43*a*. The result is then stored in the appliance's storage means 36, as a more preferable cooking information. The same process also applies to the management's learning function means 44*b*. With a coordinated function of the above process between the appliance control system 25 and the management system 33, the both can retain the more preferable cooking information of the same recipe in each of the appliance's storage means 36 and the management's information storage means 37.

With the present embodiment as described in the foregoing, the appliance controller 32 is provided with the appliance's learning function means 44*a,* and the management system 33 is provided with the management's learning function means 44*b*. In the appliance control system 25, the appliance's learning function means 44*a* stores the more preferable cooking information in the appliance's storage means 36 based on the frequency of use of the cooking information stored in the appliance's storage means 36 and the modified information stored in the appliance's second storage means 43*a*. Also in the management system 33, the management's learning function means 44*b* stores the more preferable cooking information in the management's information storage means 37 in the same manner. Accordingly, the same more preferable cooking information can be retained by both of the appliance control system 25 and the management system 33 with a coordinated function of the above process between them. When a cooking is carried out by the appliance alone according to the more preferable cooking information, it can be processed faster than if it is done via the management system 33, as a matter of course. It also helps to reduce a load on the management system 33.

Ninth exemplary embodiment

Figure 12:
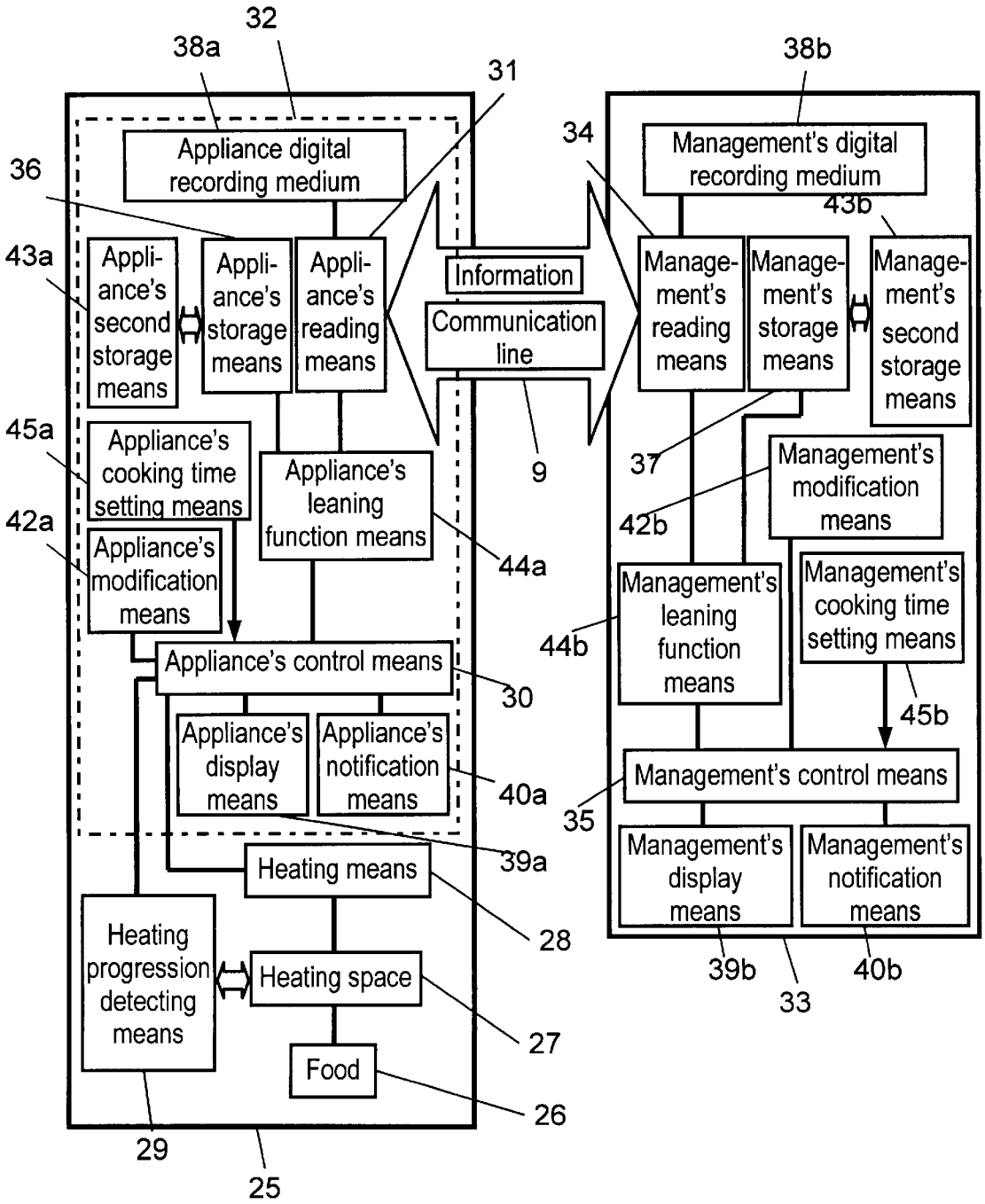
FIG. 12 is a block diagram depicting a configuration of a cooking appliance of a ninth exemplary embodiment of the present invention.

A ninth exemplary embodiment is described hereinafter by referring to a block diagram of FIG. 12. Any components having the same structure as the first through the eighth exemplary embodiments are assigned with the same reference numerals and the detailed descriptions are omitted. The ninth embodiment differs from the eighth exemplary embodiment in that the appliance controller 32 is provided with an appliance's cooking time setting means 45*a*. and the management system 33 is provided with a management's cooking time setting means 45*b*, so that a time can be set for starting or finishing the cooking.

An operation and function are described hereinafter. When the user sets either a starting time or a finishing time of a cooking with the appliance's cooking time setting means 45*a*, the information is read and the time is established by the management's cooking time setting means 45*b* in the management system 33 through the communication pathway 9. The management's control means 35 remotely controls the cooking to start or to finish according to the cooking time established with the management's cooking time setting means 45*b*.

As described in the foregoing, the ninth embodiment provides the appliance controller 32 with the appliance's cooking time setting means 45*a*, and the management system 33 with the management's cooking time setting means 45*b*. They improve a convenience of use, since the cooking can be started or finished at a time most desirable to the user by enabling it to start or finish the cooking with a remote control at the time set by the user with the appliance's cooking time setting means 45*a*.

Tenth exemplary embodiment

Figure 13:
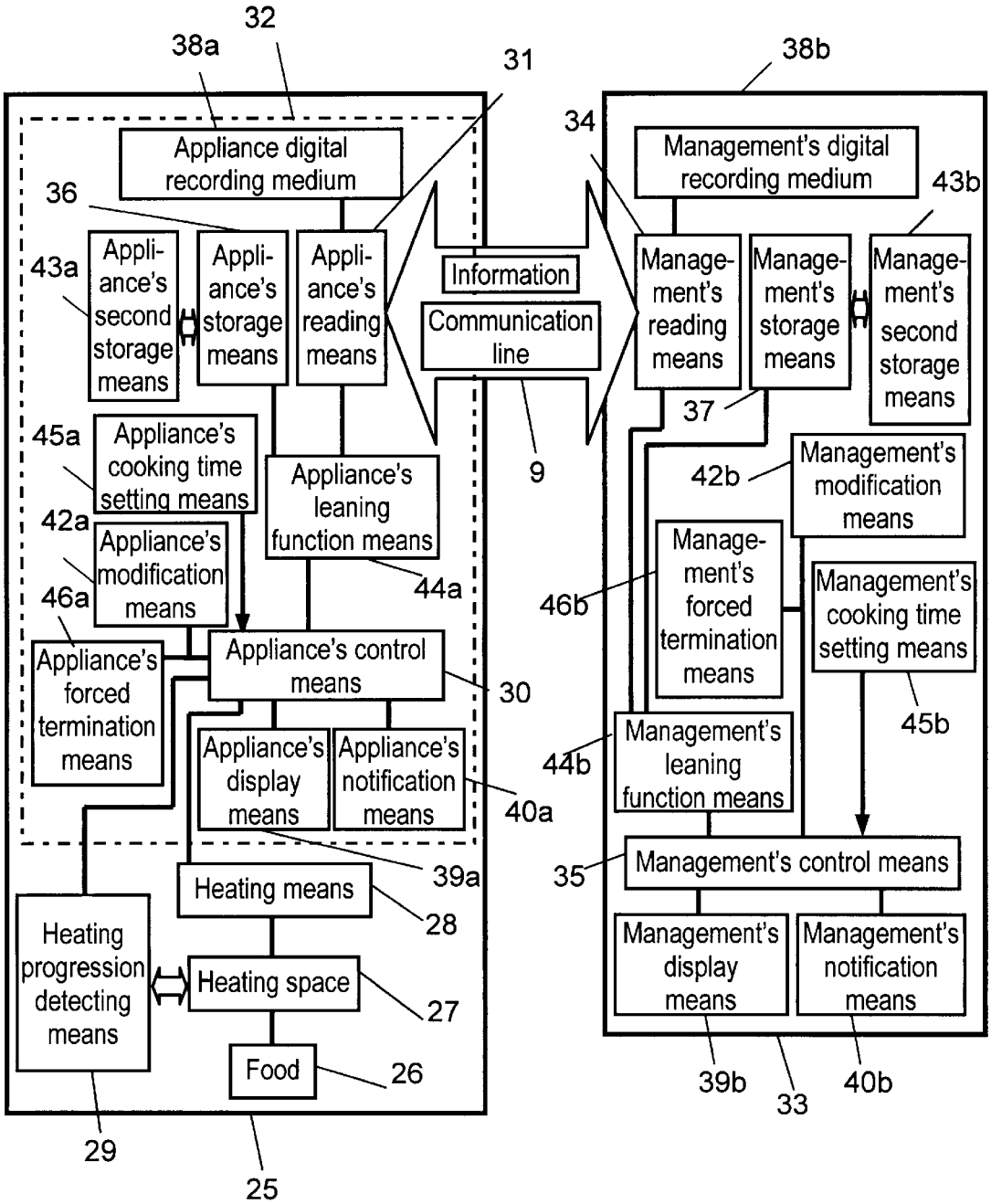
FIG. 13 is a block diagram depicting a configuration of a cooking appliance of a tenth exemplary embodiment of the present invention.

A tenth exemplary embodiment is described hereinafter by referring to a block diagram of FIG. 13. Any components having the same structure as the first through the ninth exemplary embodiments are assigned with the same reference numerals and the detailed descriptions are omitted. The tenth embodiment differs from the ninth exemplary embodiment in that the appliance controller 32 is provided with an appliance's forced termination means 46*a*, and the management system 33 is provided similarly with a management's forced termination means 46*b*, so as to forcibly terminate the cooking if an abnormality occurs in an exchange of the information through the communication pathway 9.

An operation and function are described hereinafter. If a failure occurs in exchanging an information through the communication pathway 9 between the appliance control system 25 and the management system 33 during a cooking carried out by a remote control of the management system 33, both the appliance's forced termination means 46*a* and the management's forced termination means 46*b* forcibly interrupt the cooking. This interruption of the cooking due to an abnormality is displayed or informed to the user with the appliance's display means 39*a* or the appliance's notification means 40*a*. The same function can be adopted in the management system 33.

As described in the foregoing, the present embodiment provides the appliance controller 32 with the appliance's forced termination means 46*a*, and the management system 33 with the management's forced termination means 46*b*. Accordingly, they can prevent an abnormal cooking due to a malfunction in the remote control, since the cooking is forcibly terminated if a failure occurs in exchanging the information through the communication pathway 9 between the appliance control system 25 and the management system 33.

Eleventh exemplary embodiment

Figure 14:
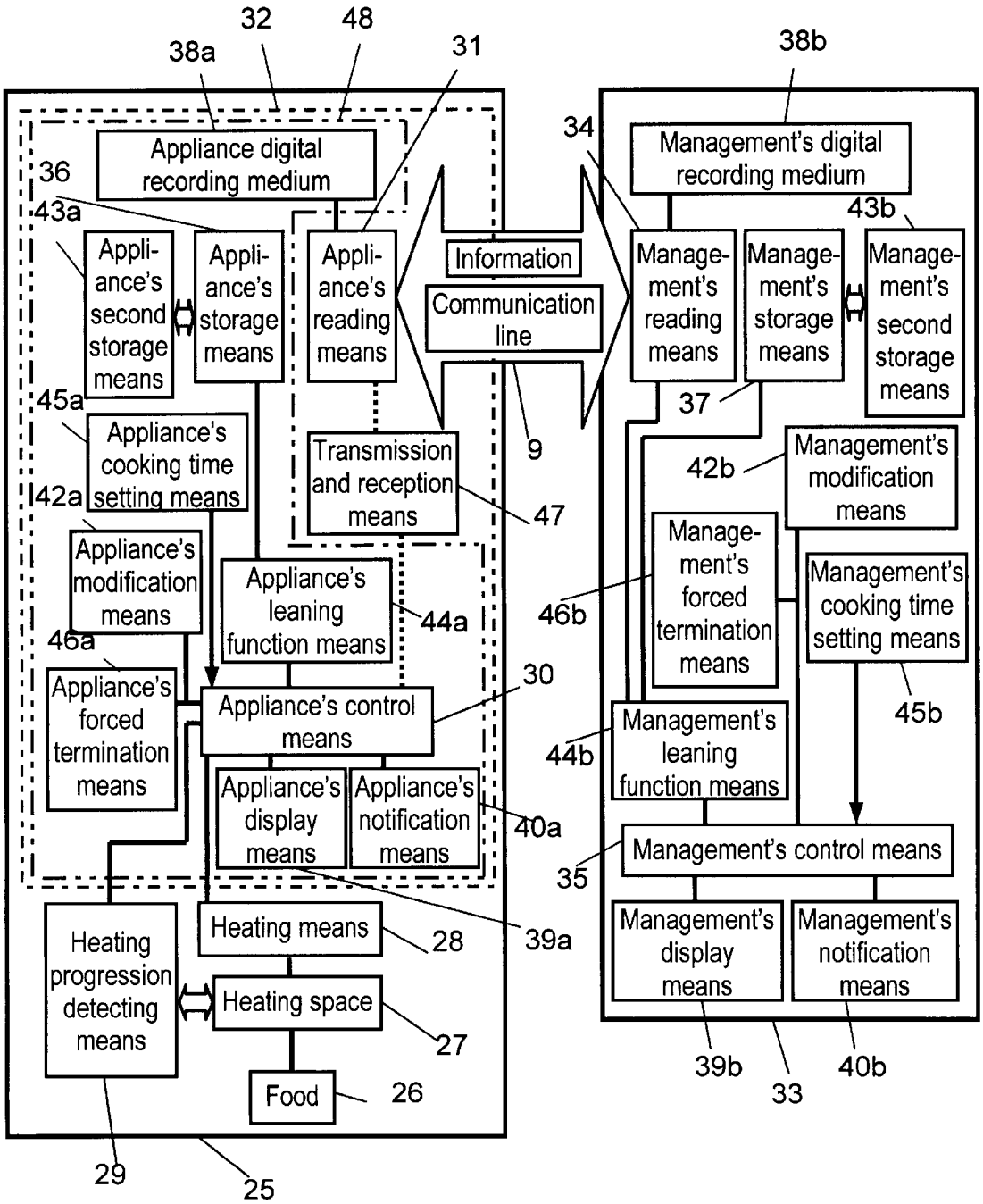
FIG. 14 is a block diagram depicting a configuration of a cooking appliance of an eleventh exemplary embodiment of the present invention.

An eleventh exemplary embodiment is described hereinafter by referring to a block diagram of FIG. 14. Any components having the same structure as the first through the tenth exemplary embodiments are assigned with the same reference numerals and the detailed descriptions are omitted. The eleventh embodiment differs from the tenth exemplary embodiment in that the appliance controller 32 is detachable from the appliance control system 25, and it is provided with a transmission and reception means 47 for coupling in a wireless communication between the appliance's control means 30 and the appliance's reading means 31. In this case, a computer connected with a network such as a personal computer 48 on the Internet is used as the appliance controller 32, and a modem is adopted as the appliance's reading means 31 for exchanging information through the communication pathway 9. Thus, the wireless communication is made with the infrared rays or low-level radio waves by the transmission and reception means 47 between the personal computer 48 and the appliance's reading means 31.

The personal computer 48 is provided with a keyboard, mouse, and the like as an input means, and a recording device for the function of the appliance's storage means 36, the appliance's digital recording medium 38*a* and the appliance's second storage means 43*a*. Also, the appliance's control means 30. the appliance's modification means 42*a*, the appliance's learning function means 44*a*, the appliance's cooking time setting means 45*a* and the appliance's forced termination means 46*a* are all substantiated by a programming operation of the personal computer 48. Moreover, the personal computer 48 is provided with a display and a sound generator for the function of the appliance's display means 39*a* and the appliance's notification means 40*a*.

An operation and function are described as follows. The appliance's reading means 31 and the personal computer 48 are coupled for wireless communication through the transmission and reception means 47. And the appliance's reading means 31, the transmission and reception means 47 and the personal computer 48 collectively compose the appliance controller 32 to perform the same function of the tenth exemplary embodiment. In this case, the appliance's reading means 31 is positioned at one end of the communication pathway 9, and the personal computer 48 is positioned near the heating space 27, which is away from that end, so that they can be coupled in a wireless communication.

The present embodiment, as described above, comprises the personal computer 48 for all the functions of the appliance controller 32 except for the appliance's reading means 31, and operates it as the appliance controller 32 by coupling between the appliance's reading means 31 connected to the communication pathway 9 and the personal computer 48 with the transmission and reception means 47 for the wireless communication. This enables the appliance to control the heating means 28 with a widely available personal computer 48.

It needs no mentioning that a use of the personal computer in the present embodiment is an example, and it is not intended to be restrictive to the personal computer.

Twelfth exemplary embodiment

Figure 15:
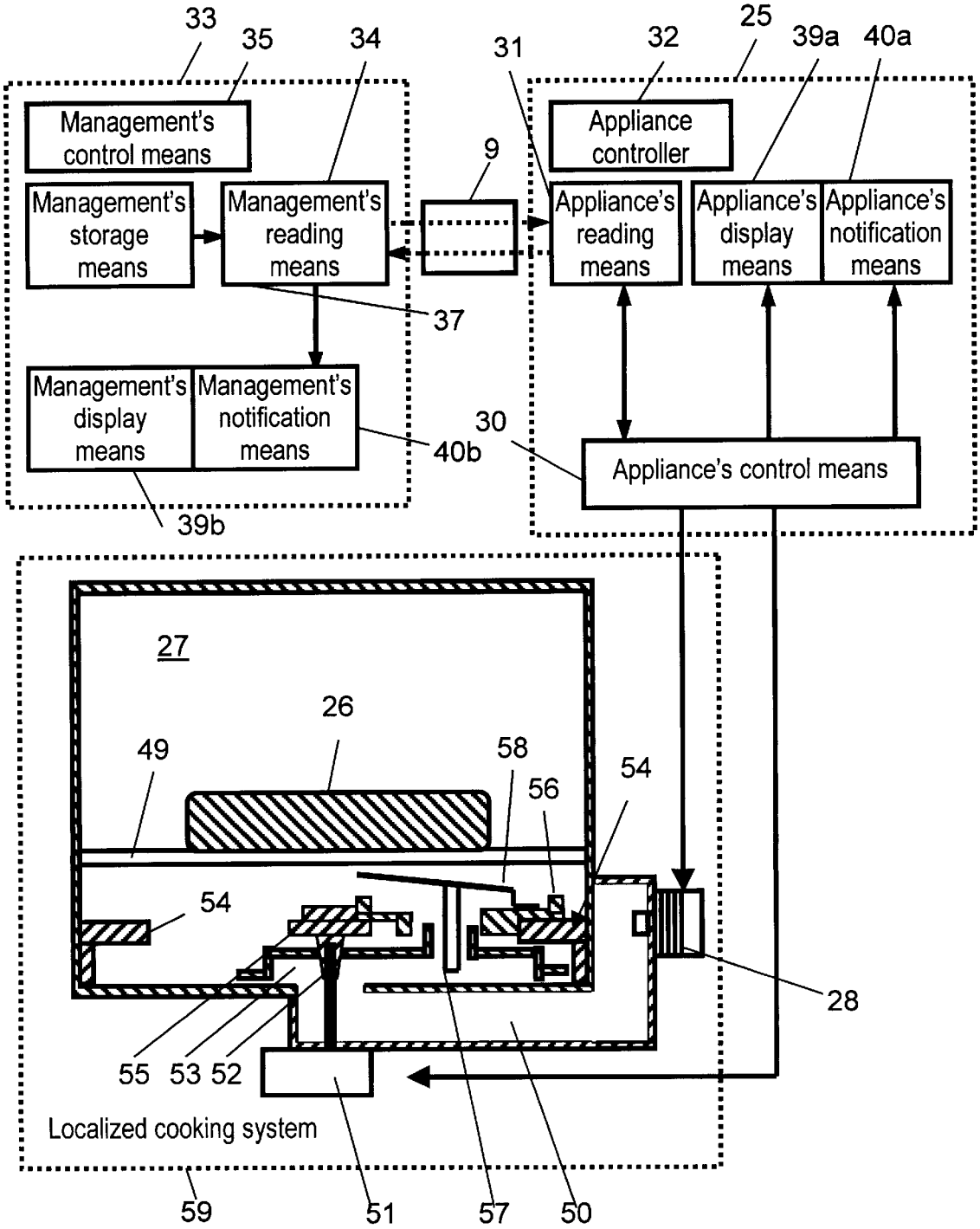
FIG. 15 is a structural diagram depicting a cooking appliance of a twelfth exemplary embodiment of the present invention.
Figure 16:
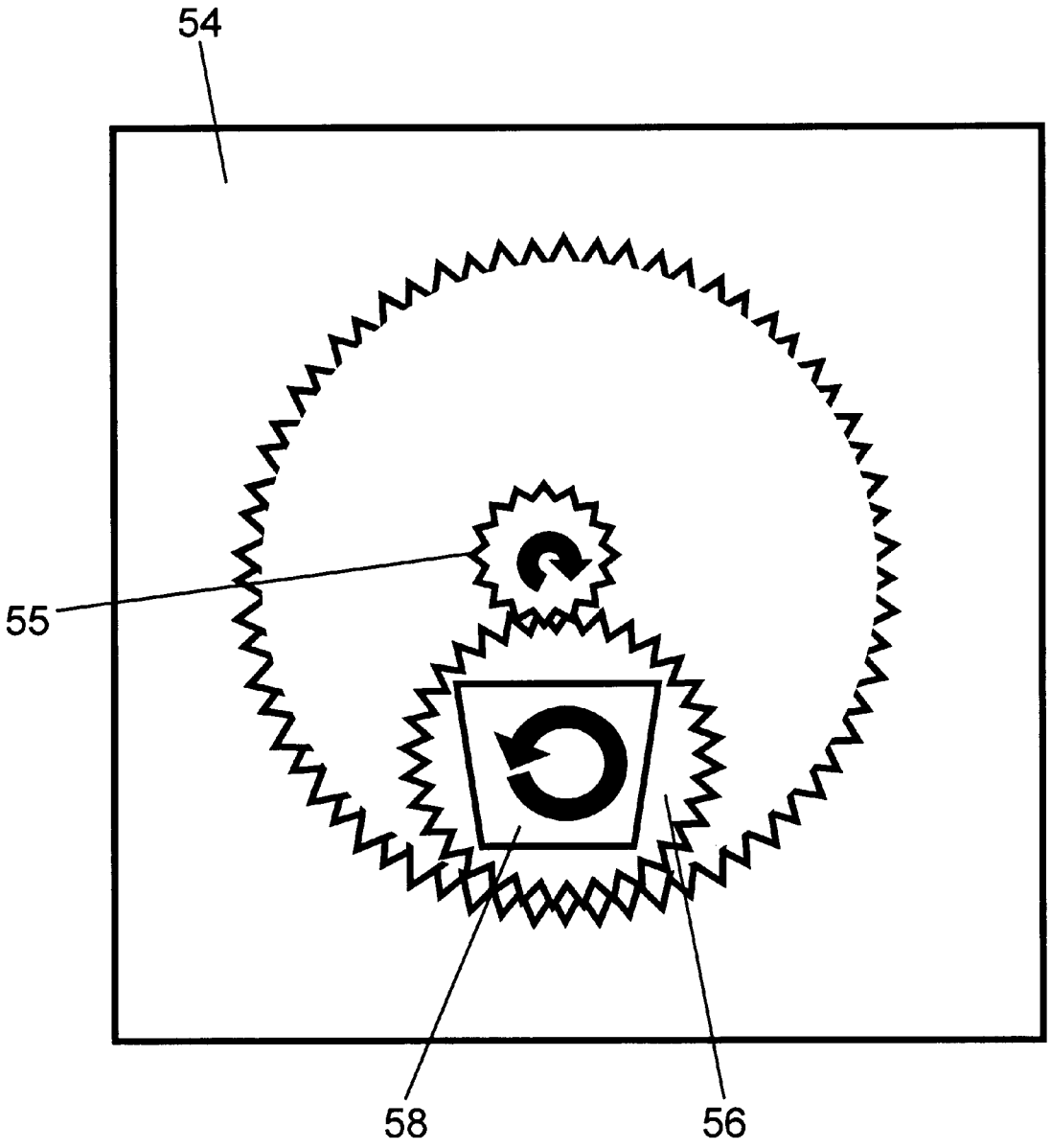
FIG. 16 is a plan view depicting a waveguide driving unit in a localized cooking system of the same exemplary embodiment.
Figure 17:
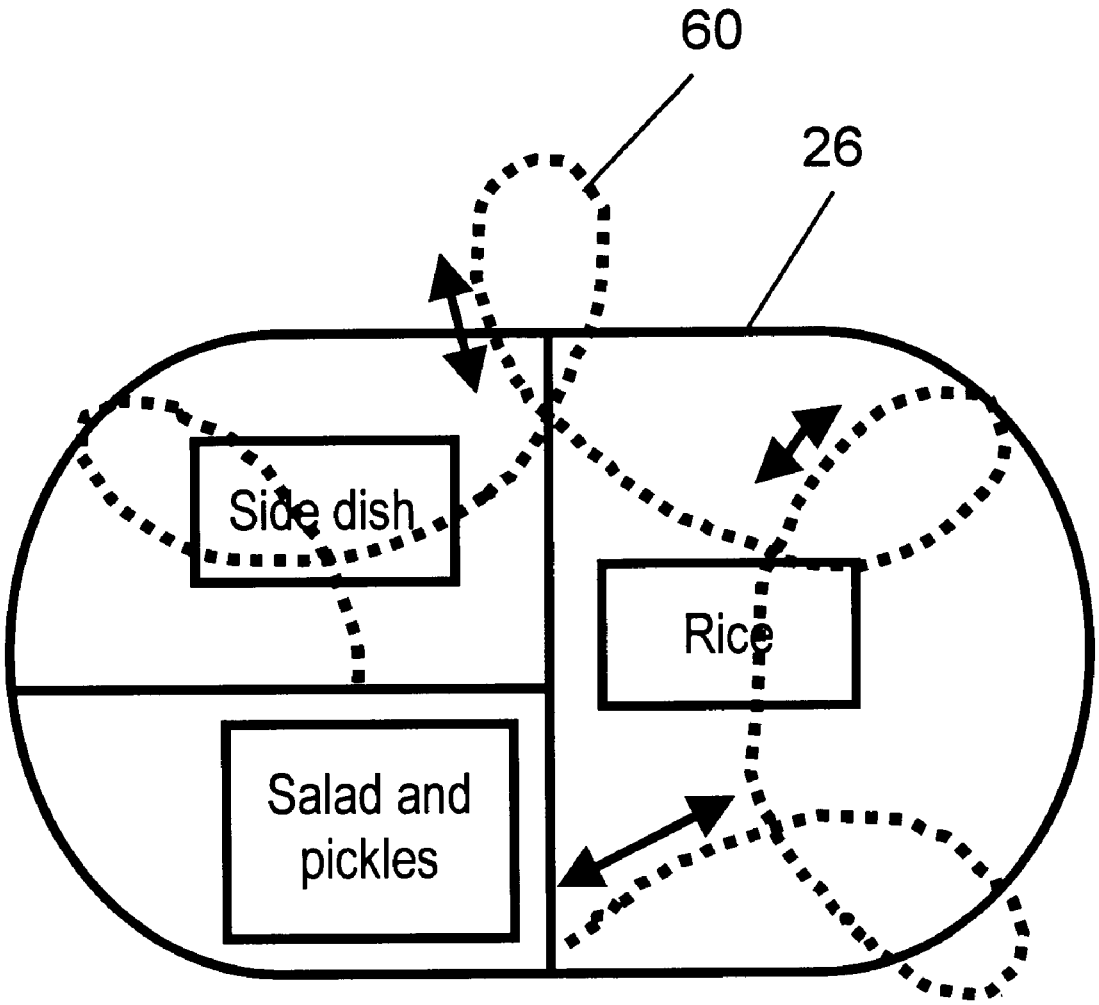
FIG. 17 is a drawing depicting a locus of the waveguide driving unit of the same exemplary embodiment.
Figure 18:
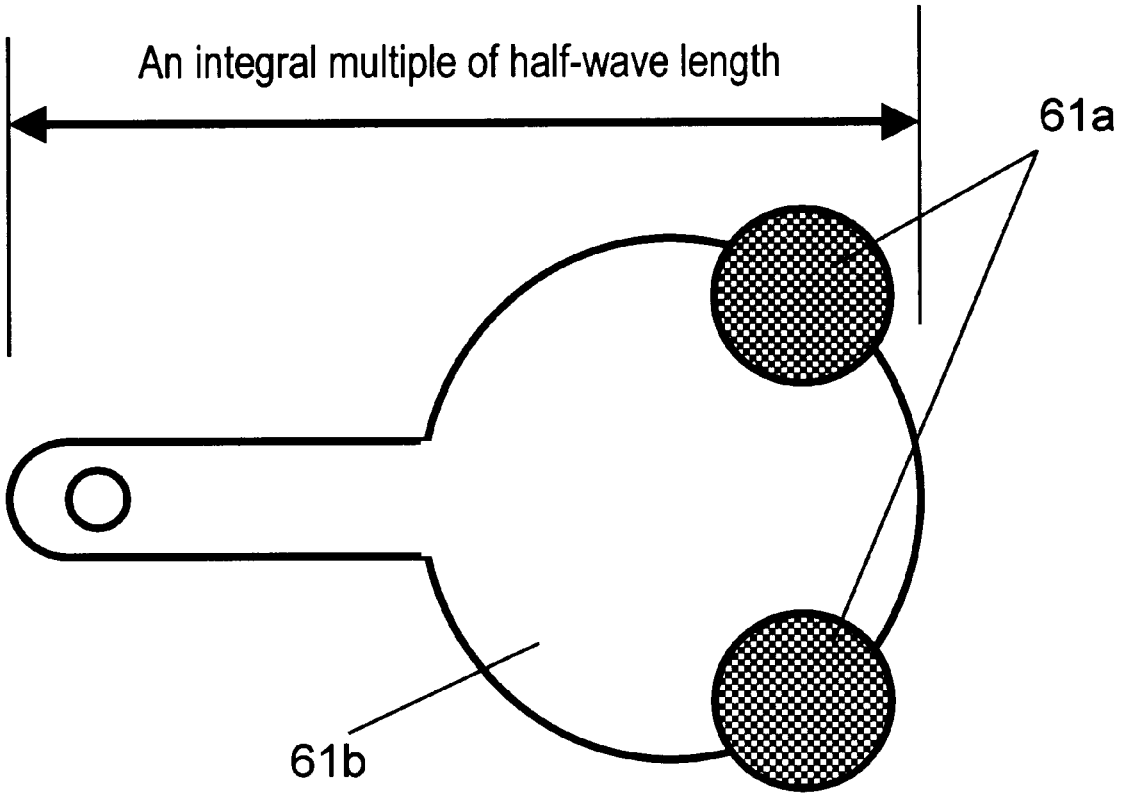
FIG. 18 is an illustrative drawing of an antenna of another method in a localized cooking system of the same cooking appliance.

A twelfth exemplary embodiment is described hereinafter by referring to drawings of FIG. 15 through FIG. 17. FIG. 15 is an overall structural diagram depicting a cooking appliance of the twelfth exemplary embodiment, FIG. 16 is a plan view of a waveguide driving unit realizing a localized cooking of the same cooking appliance, and FIG. 17 is a drawing depicting a locus of the waveguide driving unit at a radiating port when a box lunch is cooked. Any components having the same structure as the first through the eleventh exemplary embodiments are assigned with the same reference numerals and the detailed descriptions are omitted.

In FIG. 15 through FIG. 17 a management system 33 comprises a management's information storage means 37 for storing cooking information and the like, a computer 35 as a management's control means, a management's reading means 34 for communicating the cooking information, etc. with the appliance, a management's display means 39*b,* and a management's notification means 40*b.* An appliance control system 25 comprises a computer 32 as an appliance controller, an appliance's reading means 31 for exchanging information with the management's reading means 34 of the management system 33, an appliance's display means 39*a,* an appliance's notification means 40*a,* and an appliance's control means 30. A communication of the information is made between the management system 33 and the appliance control system 25 through a communication pathway 9. A localized cooking system 59 comprises a heating means 28 consisting of a magnetron for oscillating high frequency waves, a food 26 for being heated, a cooking chamber 27 as a heating space confined by a metal for cooking the food 26 with the high frequency waves, a shelf 49 for placing the food 26, a waveguide 50 for leading the high frequency power waves oscillated by the heating means 28 into the cooking chamber 27, a motor 51, a shaft "A" 52 mounted to the waveguide 50 for connecting with the motor 51, a rotary waveguide 53 mounted to the waveguide 50 by the shaft "A" 52 for being rotatable about the shaft "A" 52, a peripheral guide 54 formed with a gear on its inner rim, a gear "A" 55 fixed to the shaft "A" 52 connected for rotation with the motor 51, a gear "B" 56 held between the gear "A" 55 and the gear of the peripheral guide 54 for rotating in a cycloidal motion along the peripheral guide 54 while also rotating on it's own axis, a shaft "B" 57 fixed to the rotary waveguide 53, and a radiating port 58 linked to the shaft "B" 57 for radiating the high frequency waves while rotating in a direction of 360 degrees along with a rotation of the gear "B" 56.

In the driving section of the rotary waveguide 53 for realizing the localized cooking, when the gear "A" 55 rotates along with a rotation of the motor 51 via the shaft "A" 52, the radiating port 58 moves as shown by the locus 60, as it makes a cycloidal movement while rotating, since the gear "B" 56 held between the gear "A" 55 and the peripheral guide 54 makes the cycloidal motion while also rotating on it's axis. Accordingly, the radiating port 58 of the localized cooking system 59 cooks the foods 26, i.e. an object to be heated, with the appliance's control means 30, while moving along the locus 60, as cooking information such as kinds of food materials as rice, side dishes, salad, pickles, etc., their positions, necessity of cooking, and the like are given to it by the management system 33.

An operation and function are described as follows. If the object 26 to be heated is a box lunch, cooking information of the box lunch such as a kind of the lunch, arrangement of food materials in the box, a cooking time, a cooking appliance data, etc. are stored in the management's information storage means 37 of the management system 33. The management system 33, by the management's reading means 34, transmits the cooking information to the appliance control system 25 through the communication pathway 9, e.g. telephone line, and via the appliance's reading means 31. The appliance's reading means 31 reads the cooking information transmitted from the management system 33, and the appliance's control means 30 of the appliance control system 25 displays or informs of the information with the display means 39*a* or the notification means 40*a* of the appliance. And the appliance's control means 30 carries out the localized cooking by controlling the locus 60 of the radiating port 58 in a manner to cook an area of the rice and the side dishes and not to cook an area of the salad and the pickles according to the cooking information, as shown in FIG. 17, with the heating means 28 consisting of a magnetron. This localized cooking system 59 leads the high frequency power waves eradiated by the heating means 28 through the waveguide 50 to the rotary waveguide 53, and cooks by radiating the high frequency waves from the radiating port 58 that moves along a predetermined locus 60. The localized cooking system 59 for executing the selective cooking is operated by the appliance's control means 30 according to the cooking information. First, the motor 51 is operated by the appliance's control means 30. A revolution of the motor 51 is transmitted and rotates the rotary waveguide 53 linked by the shaft "A" 52, and leads the high frequency waves guided by the waveguide 50 into the radiating port 58. On the other hand, the radiating port 58 eradiates the high frequency waves for cooking while it gets closer to the object 26 to be heated, since it eradiates the high frequency waves while in a movement as shown by the locus 60 due to the rotation around its own axis and the cycloidal motion of the gear "A" 55 rotated by the motor 51. Since cooking areas of the object 26 to be heated can be controlled as described above, it can realize an error-free cooking in quite a short period of time, if the cooking information for the box lunch is arranged to be input automatically to the appliance's control means 30 in advance.

Also, since the cooking information such as an arrangement of food materials in the box lunch, a cooking time, a cooking appliance data, etc. are always renewed according to the program even if a kinds of the box lunch changes frequently in a convenience store, etc., the user is able to cook only the predetermined materials by simply placing the box lunch, thereby making the cooking appliance remarkably easy to use.

Although the foregoing localized cooking system 59 changes the direction of the radiating port 58 with rotation of the peripheral guide 54, the gear "A" 55 and the gear "B" 56 driven by the motor 51 controlled with the appliance's control means 30, the radiating port 58 may be substituted with a metal antenna 61*b* having a length of an integral multiple of half-wave length to create a portion of intense electric field 61*a* with the metal antenna 61*b* linked to the shaft "B" 57, and these are not exclusive.

In this example, the metal antenna 61*b* linked to the shaft "B" 57 utilizes the characteristic that the portion of intense electric field 61*a* having a strong high frequency field (antinode of electric field) is formed at a distal end of the antenna when it is shaped to conform to an integral multiple of half-wave length of the applied high frequency wave. This enables a simple structure to constitute the localized cooking system 59.

Thirteenth exemplary embodiment

Figure 19A:
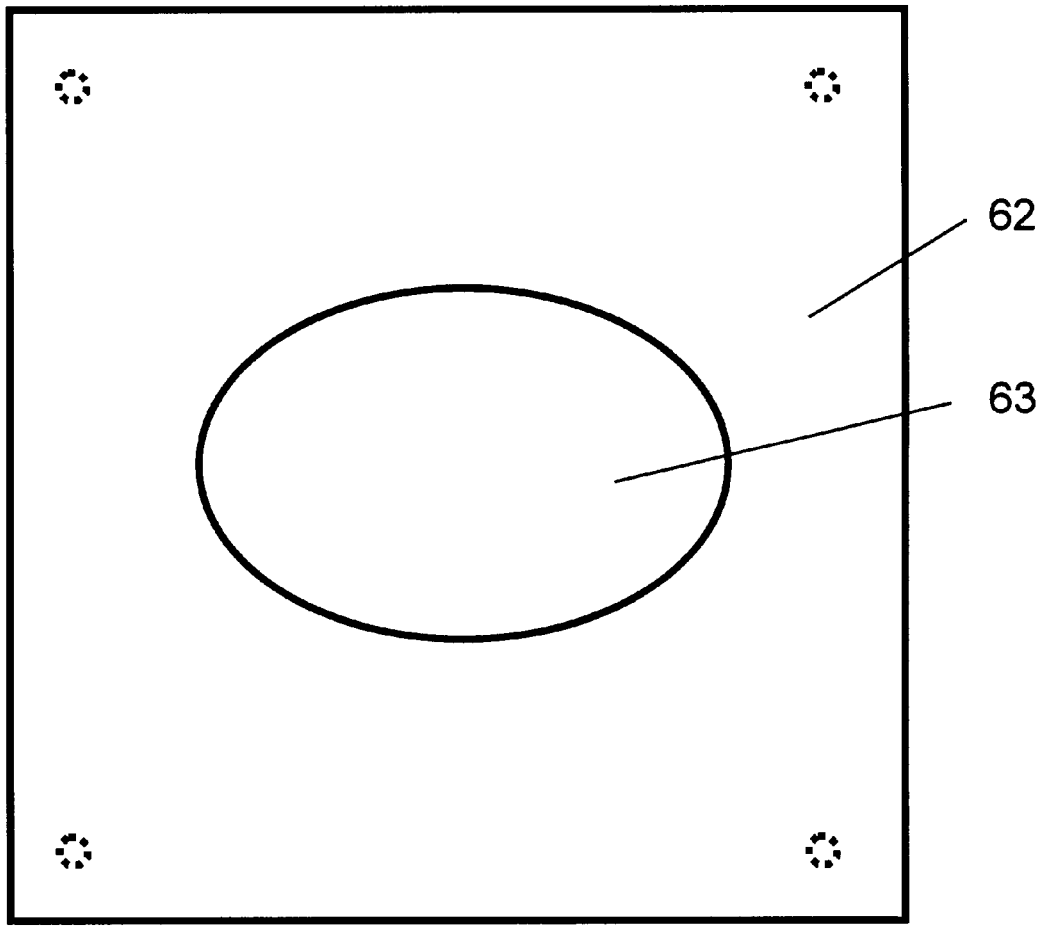
FIG. 19*a* is a plan view of an attachment used in a cooking appliance of a thirteenth exemplary embodiment of the present invention.
Figure 19B:
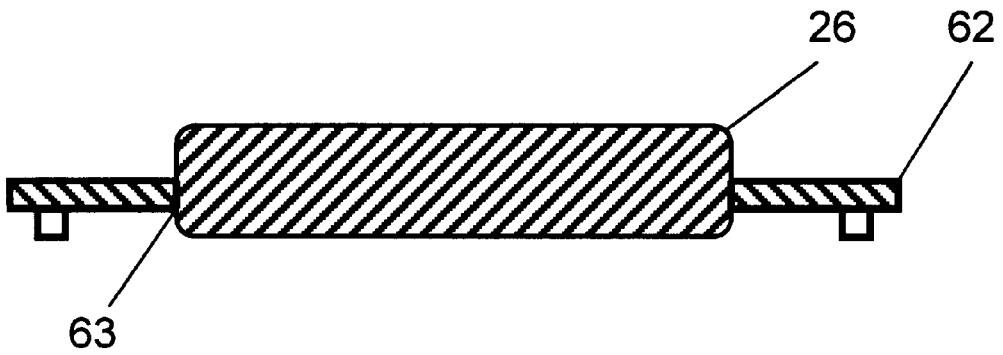
FIG. 19*b* is a cross sectional view of the same attachment.

FIG. 19*a* and FIG. 19*b* are drawings depicting an attachment used in the cooking appliance of a thirteenth exemplary embodiment. The thirteenth exemplary embodiment differs from the twelfth embodiment in a structure that restricts a position for placing the object 26 to be heated in the cooking chamber 27 by an attachment 62.

Any components having the same structure as the twelfth exemplary embodiments are assigned with the same reference numerals and the detailed descriptions are omitted.

An operation and function of it are described hereinafter. A size of the attachment 62 is designed to fit with the dimensions of the bottom surface of the cooking chamber 27. A center of the attachment 62 is provided with an opening 63 for inserting the object 26 to be heated, so as to retain the object 26 to be heated in the center position by the opening 63 fit for it. Since a size of the object 26 to be heated like a box lunch is standardized in general, the opening 63 to fit for the size can position the object 26 to be heated in the center at all the time. This enables the stable localized cooking to finish a cooking of each food zone always in the same temperature, thereby realizing a uniform cooking of the food material according to the cooking information of the object 26 to be heated.

Fourteenth exemplary embodiment

Figure 20:
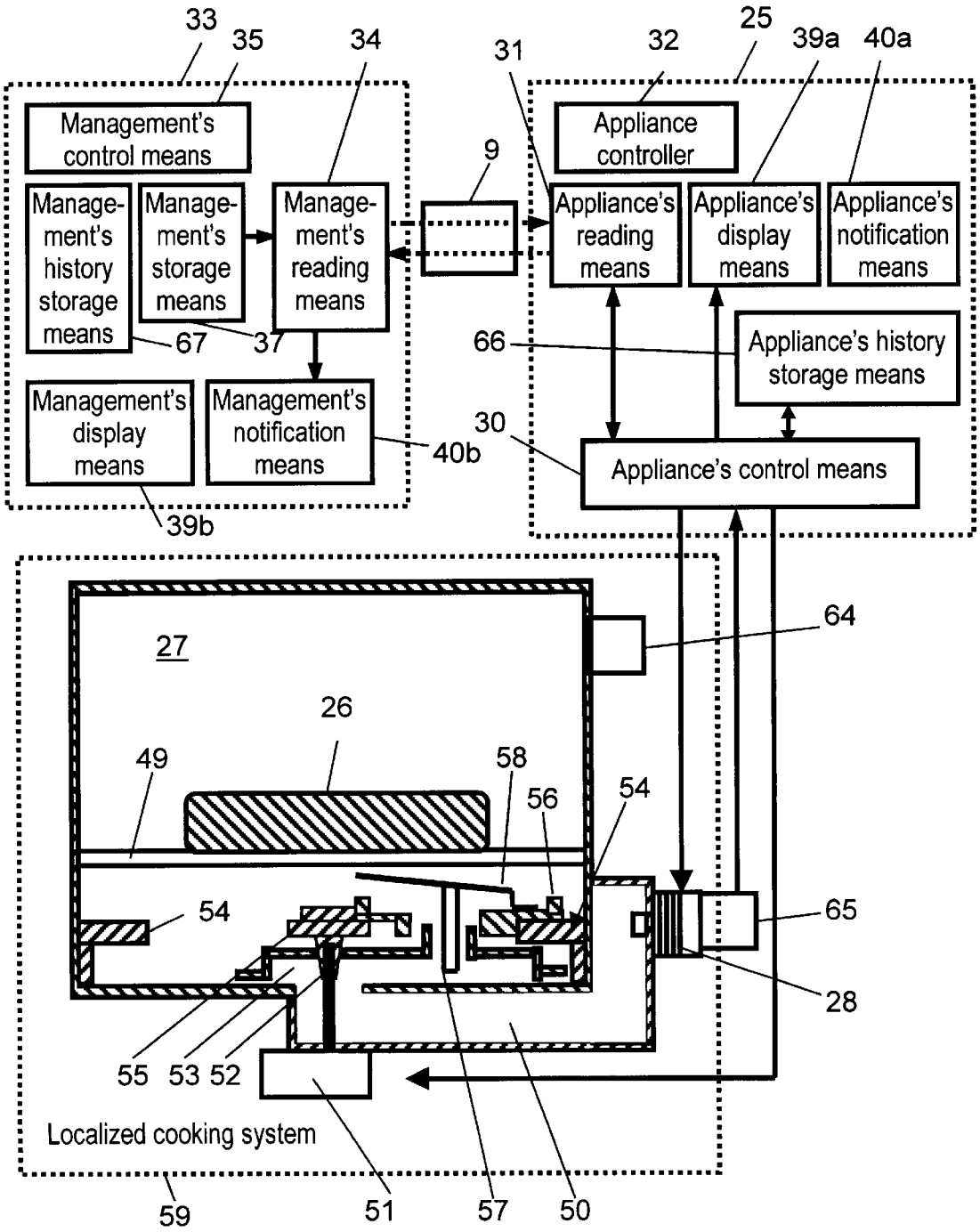
FIG. 20 is a structural diagram depicting a cooking appliance of a fourteenth exemplary embodiment of the present invention.

FIG. 20 is an overall structural diagram depicting a cooking appliance of a fourteenth exemplary embodiment. The fourteenth exemplary embodiment differs from the twelfth embodiment in that the cooking chamber 27 is provided with detecting means 64 and 65 for detecting a heating progress of the object 26 to be heated or an operating condition. Also, the appliance control system 25 and the management system 33 are each provided with history storage means 66 and 67 for storing the detected results, so that the historical information are communicated by the appliance's control means 30 and the management's control means 35 of each system.

Any components having the same structure as the twelfth exemplary embodiment are assigned with the same reference numerals and the detailed descriptions are omitted.

An operation and function of it are described hereinafter. A humidity sensor for detecting vapor produced by the object 26 being heated can be used as an example of the detecting means 64 for detecting a heating progress of the object 26 to be heated. The humidity sensor in this case detects a finishing result of the object 26 being heated indirectly by a change in the electric resistance due to adhesion of the vapor on a surface of a porous ceramic. Also, an infrared sensor may be used for detecting a surface temperature of the object being heated for the detecting means 64. The infrared sensor in this instance detects a temperature of the object 26 being heated without making a contact to it by amplifying a small electric current generated on a surface of a ferroelectric ceramic in proportion to an amount of the infrared rays incident from the object 26 being heated. On the other hand, a thermistor can be used for the detecting means 65 for detecting a temperature of the magnetron, which is the heating means 28, or a temperature of its anode. A supervisory function of the detecting means 65 for detecting an operating condition of the heating means 28 can realize the proper cooking at all the time, since an increase in temperature of the heating means 28 causes a lower cooking efficiency and/or a malfunction of the heating means 28.

The appliance's control means 30 stores the results detected by the detecting means 64 and 65 for each cooking of the objects 26 being heated in the history storage means 66 of the appliance control system 25. The contents stored in the history storage means 66 of the appliance control system 25 are also stored in the history storage means 67 of the management system 33 by passing them through the appliance's control means 30, the appliance's reading means 31, the communication pathway 9 and the management's reading means 34 of the management system 33. The heating conditions of the objects 26 to be heated and their operating conditions are stored in each of the history storage means 66 and 67, and further, with the control means 30 and 35 of each system to communicate the information of history, the cooking history of the objects 26 to be heated can also be stored. The systems can thus promptly cope with a sanitary control of the objects 26 to be heated, a prevention of food poisoning, the HACCP (Hazard Analysis Critical Control Points), and a failure estimation and maintenance of the appliance.

Although the foregoing embodiment has referred to the humidity sensor and the infrared sensor for the detecting means 64, an electric field sensor having an antenna for detecting a difference between an amount of the high-frequency wave emission from the heating means 28 and an amount of the high-frequency wave absorbed by the objects 26 being heated may also be used, and these are not exclusive.

Moreover, although the described embodiment has referred to the case in that the detecting means 65 detects a temperature of the heating means 28, other means for detecting a cumulative time of actual operation of the heating means 28 can also be used, and these are not exclusive.

Fifteenth exemplary embodiment

Figure 21:
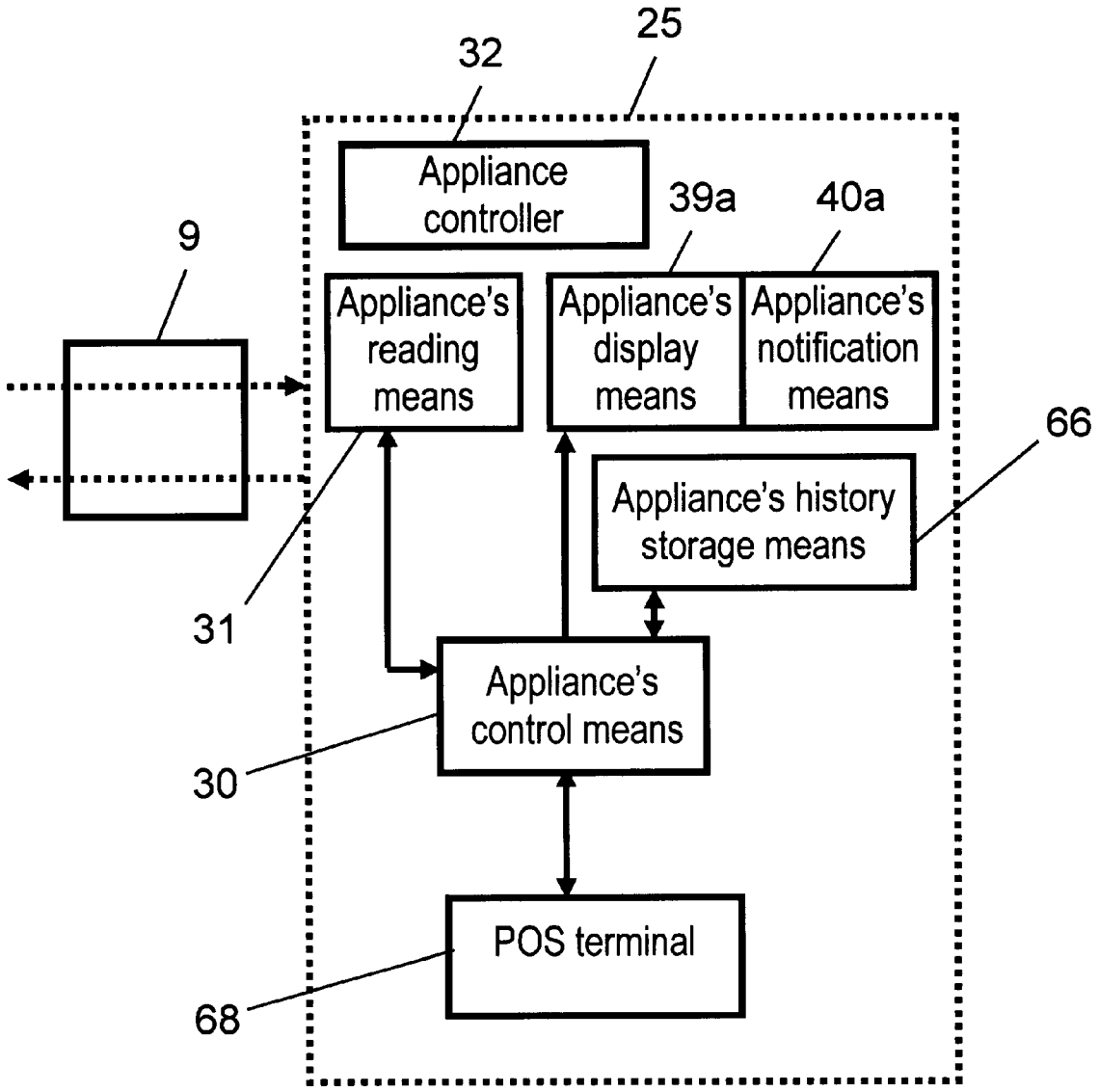
FIG. 21 is a block diagram depicting an appliance control system of a cooking appliance of a fifteenth exemplary embodiment of the present invention.

FIG. 21 is a block diagram depicting an appliance control system of a cooking appliance of a fifteenth exemplary embodiment. A structure of the fifteenth exemplary embodiment differs from the fourteenth embodiment in that the appliance control system 25 is provided with a POS terminal 68. Any components having the same structure as the twelfth through the fourteenth exemplary embodiments are assigned with the same reference numerals and the detailed descriptions are omitted.

An operation and function of it are described hereinafter. The POS terminal 68 is capable of transmitting a command to the appliance's control means 30 for designating a target portion of an object 26 to be heated, when a customer purchases the object 26 to be heated such as a box lunch, and a store clerk settles the payment with the appliance control system 25.

The appliance's control means 30 makes the appliance's display means 39*a* display a content and price of the object 26 to be heated, or activates the notification means 40*a* to sound, or causes the history storage means 66 to store it. The content stored in the history storage means 66 of the appliance control system 25 is also stored in the history storage means 67 of the management system 33 by passing through the appliance's reading means 31 and the communication pathway 9. Since a purchasing pattern of the objects 26 to be heated is stored in the history storage means 66 and 67, and further, with the appliance control system 25 and the management system 33 to communicate the information of history with each other, they can promptly cope with the sales management of the objects 26 to be heated and a new order of the objects 26 to be heated.

Sixteenth exemplary embodiment

Figure 22:
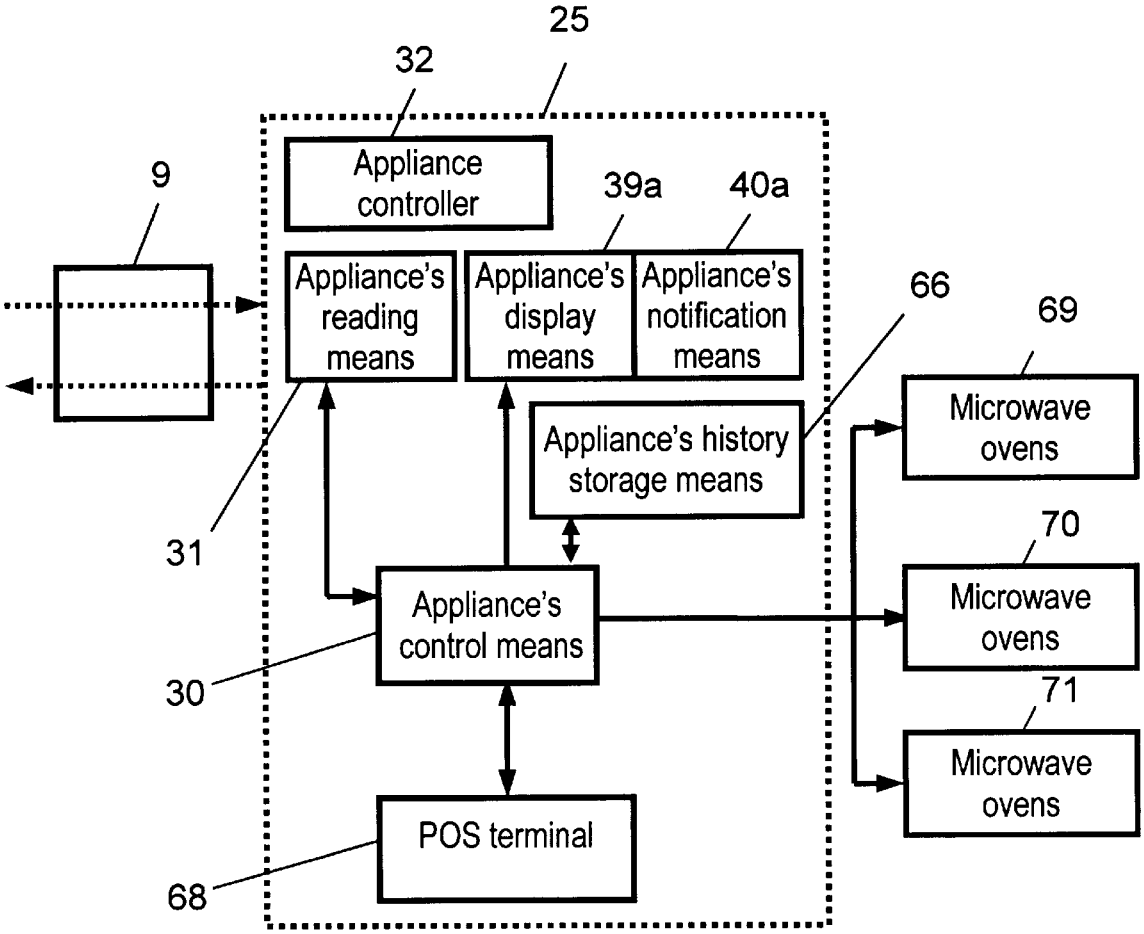
FIG. 22 is a block diagram depicting an appliance control system of a cooking appliance of a sixteenth exemplary embodiment of the present invention.

FIG. 22 is a block diagram depicting an appliance control system of a cooking appliance of a sixteenth exemplary embodiment. A structure of the sixteenth exemplary embodiment differs from the fifteenth embodiment in that the appliance control system 25 has a function to control a plurality of cooking appliances. Any components having the same structure as the twelfth through the fifteenth exemplary embodiments are assigned with the same reference numerals and the detailed descriptions are omitted.

The appliance's control means 30 of the appliance control system 25 distributes commands for designating a target portion of the object 26 to be heated to each of the plurality of cooking appliances, i.e. microwave ovens 69, 70 and 71. The appliance's control means 30 selects one microwave oven available for cooking among those ovens 69 through 71 by a command from the POS terminal 68, even when congested with cooking of box lunches during a lunch hour. Also, since the appliance's control means 30 either displays or informs the selected microwave oven available for cooking among those ovens 69 through 71 with the appliance's display means 39*a* or the appliance's notification means 40*a,* the cooking operation is tactfully executed even in a congested lunch hour.

Seventeenth exemplary embodiment

Figure 23:
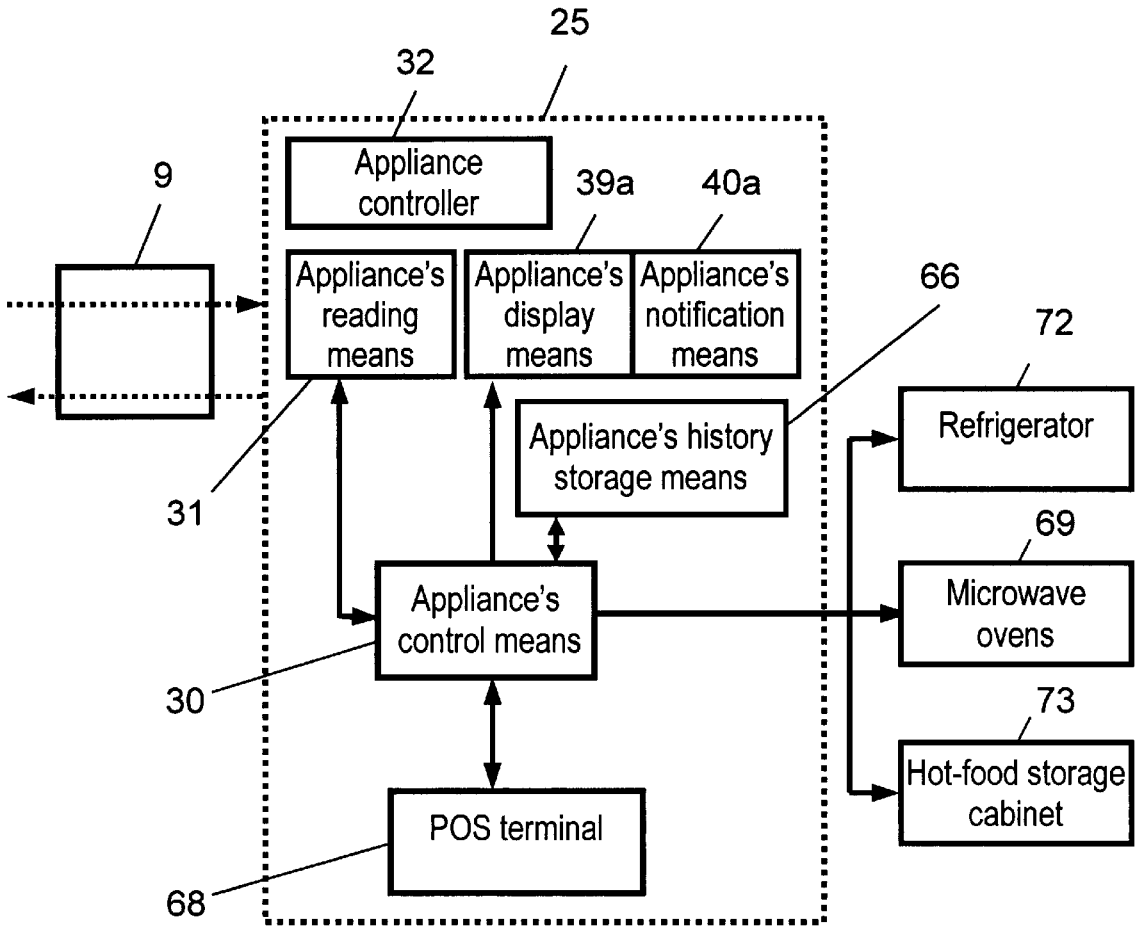
FIG. 23 is a block diagram depicting an appliance control system of a cooking appliance of a seventeenth exemplary embodiment of the present invention.

FIG. 23 is a block diagram depicting an appliance control system of a cooking appliance of a seventeenth exemplary embodiment. A structure of the seventeenth exemplary embodiment differs from the sixteenth embodiment in that the appliance control system 25 has a function to control a plurality of cooking appliances. Any components having the same structure as the twelfth through the sixteenth exemplary embodiments are assigned with the same reference numerals and the detailed descriptions are omitted.

The appliance's control means 30 of the appliance control system 25 controls a cooking information for cooking the object 26 to be heated with reference to the plurality of cooking appliances, i.e. a refrigerator 72, a microwave oven 69 and a hot-food storage cabinet 73.

Frozen box lunches have been marketed lately, as the object 26 to be heated, sold at convenience stores. When an object 26 to be heated is taken out of the refrigerator 72, the appliance's control means 30 receives a temperature control information of the object 26 to be heated. If the object 26 to be heated removed from the refrigerator 72 is subsequently cooked in the microwave oven 69, the microwave oven 69 automatically sets a cooking time, and cooks the object 26 to be heated according to the temperature control information of the object. In addition, the hot-food storage cabinet 73 keeps the object 26 to be heated in a ready-to-serve condition at all times based on the cooking information of the microwave oven 69. Furthermore, since the appliance's control means 30 either displays or informs a series of the cooking information with the appliance's display means 39*a* or the appliance's notification means 40*a,* it facilitates a storage of the object 26 after the cooking.

Eighteenh exemplary embodiment

Figure 24:
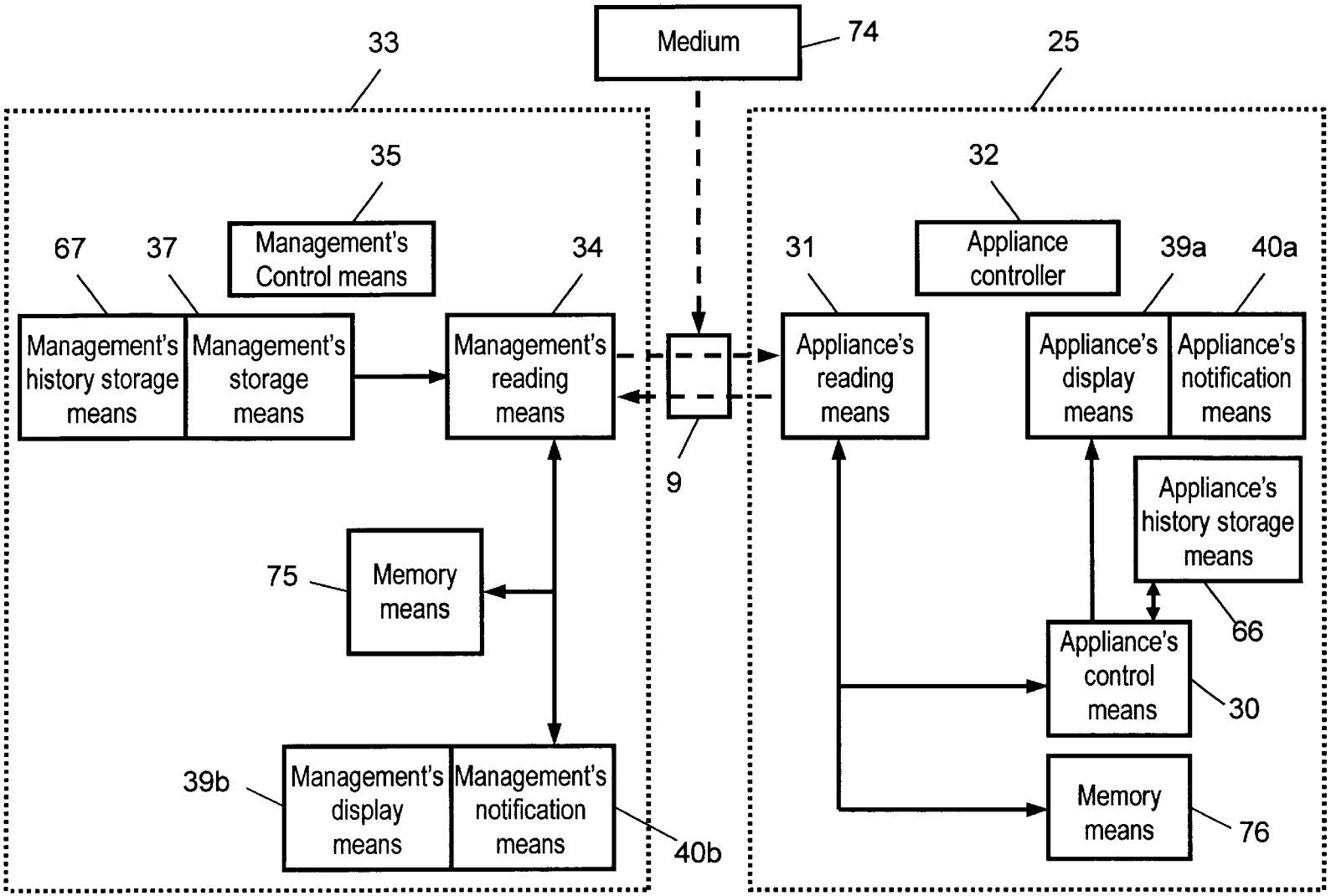
FIG. 24 is a block diagram depicting a cooking appliance of an eighteenth exemplary embodiment of the present invention.

FIG. 24 is a block diagram depicting a cooking appliance of an eighteenth exemplary embodiment. A structure of the eighteenth exemplary embodiment differs from the twelfth embodiment in that the management system 33 and the appliance control system 25 receive an information through a medium 74 such as a public communication pathway, a television, a satellite broadcasting, a surface wave, and the like, and the received information is stored in each of the memory means 75 and 76. Any components having the same structure as the twelfth exemplary embodiment are assigned with the same reference numerals and the detailed descriptions are omitted.

Since the cooking information from the medium 74 is stored in the memory means 75 and 76 provided in the management system 33 and the appliance control system 25 through the communication pathway 9, the information can be promptly renewed and stored in the case of a massive chain of convenience stores exceeding 1,000 outlets. Also, the information is quickly renewed and stored by using the widely available Internet or the satellite broadcasting, even in the case of convenience stores spreading all over the world.

Nineteenth exemplary embodiment

Figure 25:
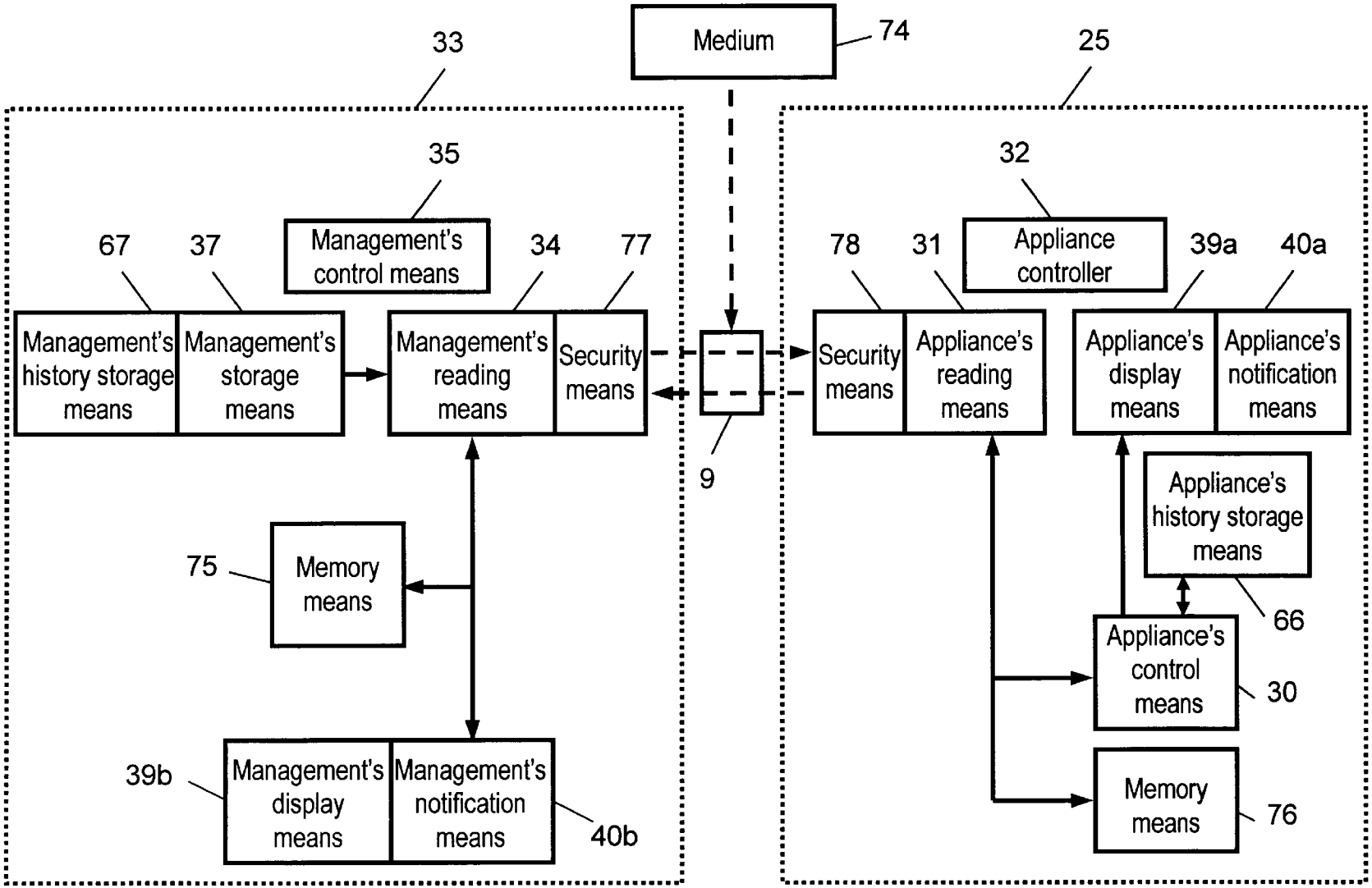
FIG. 25 is a block diagram depicting a cooking appliance of a nineteenth exemplary embodiment of the present invention.

FIG. 25 is a block diagram depicting a cooking appliance of a nineteenth exemplary embodiment. A structure of the nineteenth exemplary embodiment differs from the twelfth embodiment in that the management system 33 and the appliance control system 25 are provided with security means 77 and 78 when communicating an information between them. Any components having the same structure as the twelfth exemplary embodiment are assigned with the same reference numerals and the detailed descriptions are omitted.

The security means 77 and 78 encrypt, decrypt and/or furnish a password, when the management system 33 and the appliance control system 25 communicate cooking and the like information therebetween, thereby making it difficult for a hacker to interfere or intercept the communication, or to destroy the information, so as to achieve a secure communication of the information.

Twentieth exemplary embodiment

Figure 26:
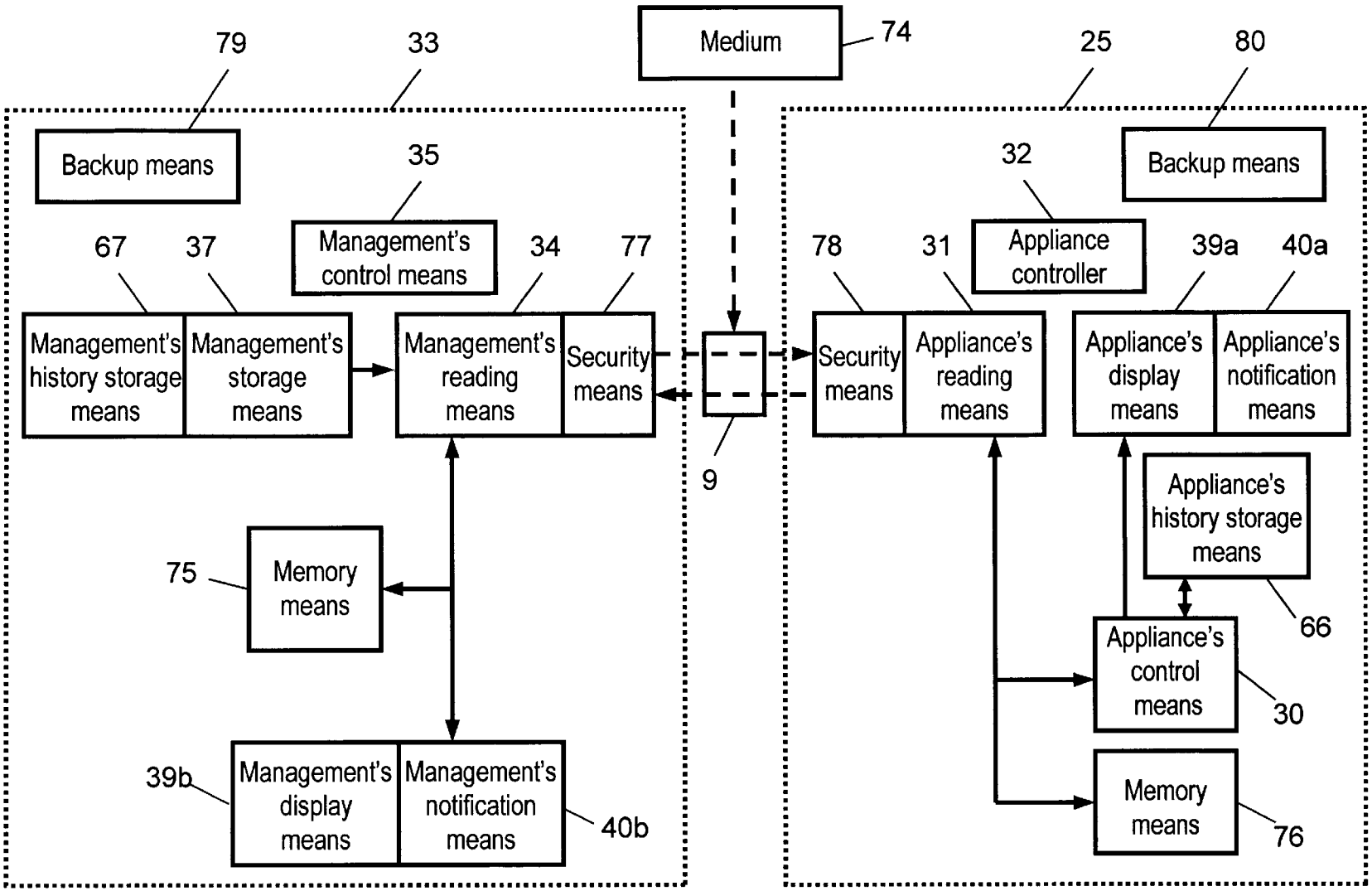
FIG. 26 is a block diagram depicting a cooking appliance of a twentieth exemplary embodiment of the present invention.

FIG. 26 is a block diagram depicting a cooking appliance of a twentieth exemplary embodiment. A structure of the twentieth exemplary embodiment differs from the twelfth embodiment in that the management system 33 and the appliance control system 25 are each provided with respective backup means 79 and 80. Any components having the same structure as the twelfth exemplary embodiment are assigned with the same reference numerals and the detailed descriptions are omitted.

The backup means 79 and 80 back up the cooking history information stored in the history storage means 66 and 67 and/or the cooking information stored in the memory means 75 and 76, so as to quickly restore the system, in the case of an interruption, a failure or a decrease in capacity of the transmission with either of the management system 33 and the appliance control system 25. Moreover, if the appliance control system 25 is interrupted from the management system 33 due to a malfunction in the communication pathway 9, the backup means 80 in the appliance control system 25 obtains a cooking information from the substituting medium 74, and stores in the memory means 76 for executing the cooking. It also stores a cooking history during the interruption into the history storage means 66, so as to communicate it with the management system 33 after restoration. Accordingly, the cooking history information can be maintained properly at all the time.

Twenty-first exemplary embodiment

Figure 27:
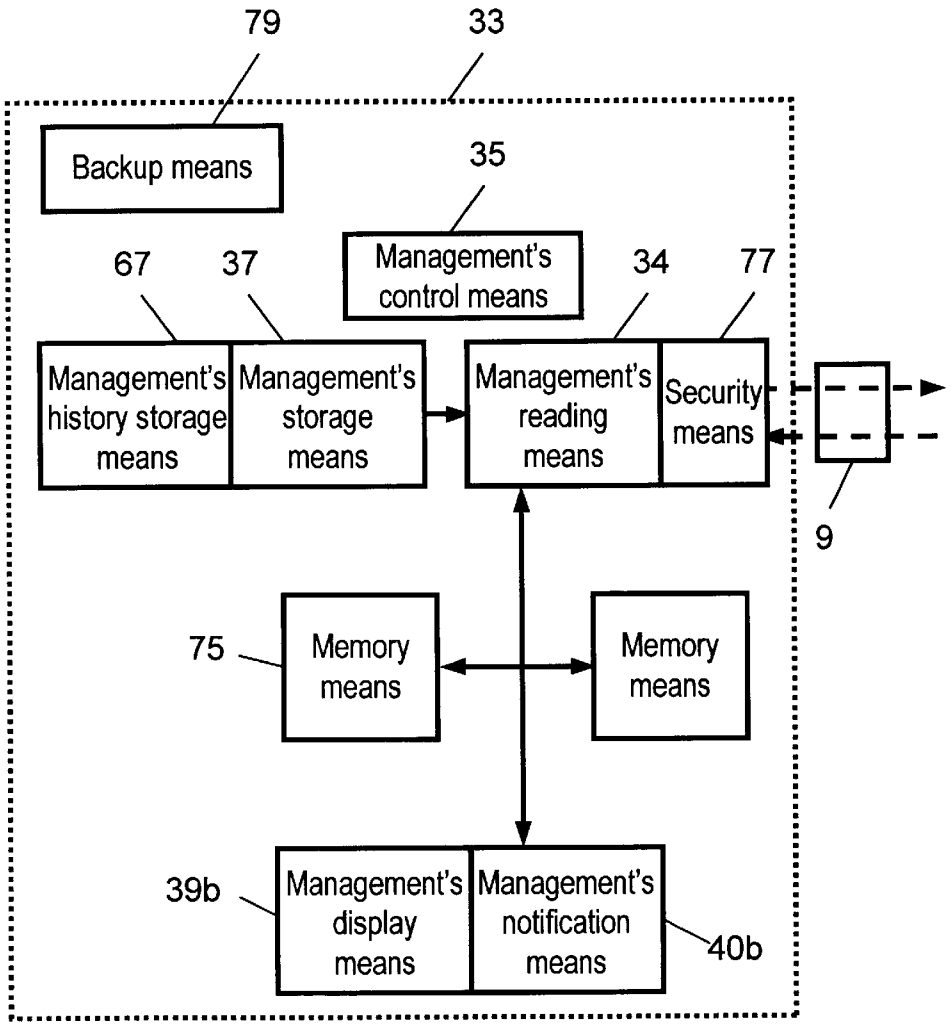
FIG. 27 is a block diagram depicting a management system of a cooking appliance of a twenty-first exemplary embodiment of the present invention.

FIG. 27 is a block diagram depicting a management system of a cooking appliance of a twenty-first exemplary embodiment. A structure of the twenty-first exemplary embodiment differs from the twelfth embodiment in that the management system 33 is provided with a billing means 81. Any components having the same structure as the twelfth exemplary embodiment are assigned with the same reference numerals and the detailed descriptions are omitted.

The billing means 81 charges in accordance with a request of the cooking information from the appliance control system 25. For example, the management system 33 maintains cooking sequence information for a numerous objects to be heated, so that the appliance control system 25 can obtain only a necessary cooking information while searching through the cooking information displayed on the appliance's display means 39*a*.

The user pays a fee for the necessary cooking information. The management side can reduce a burden of collecting the fees, if it offers information suited for the needs of the customer, and settles the fees by using an electronic banking system or the similar means.

As has been described, a cooking appliance of the present invention offers the following effects:

The appliance control system and the management system exchange with each other via the communication pathway, cooking information such as a cooking recipe and cooking condition, heating progress information and remote-control information. This enables the appliance control system to carry out the cooking easily and appropriately by remotely controlling the appliance control system with the management system in a manner to finish the food properly, even though the user has no knowledge about the cooking and/or a way to operate.

The appliance controller provided with the appliance's storage means enables it to store new cooking recipes additionally by accumulating the information received from the management system. Also, the management system provided with the management's storage means enables supervisory personnel of the management system to reflect a utilization factor and the heating condition of the appliance control system into development of new cooking recipes by accumulating the information received from the appliance control system. In addition, the information is effectively utilized for a development of new cooking recipes and cooking conditions favored by the user.

The appliance controller provided with the appliance's digital recording medium enables it to maintain cooking information corresponding to a variety of cooking recipes input through the input means, by storing in advance a numerous cooking information corresponding to cooking recipes. Also, the management system provided with the management' digital recording medium for storing in advance new cooking recipes and their cooking information enables it to forward them to the appliance control system and to serve for remotely controlling cooking of the recipes.

Ongoing cooking recipe and the cooking progress are displayed and announced by providing the appliance controller with then appliance's display means and the appliance's notification means, and the management system with the management' display means and the management' notification means. They enable the user of the appliance control system and the supervisory personnel of the management system to verify respective ongoing operations, know easily without uncertainties whether or not there is any abnormalities, and carry out the cooking properly.

The management system provided with the sequential operation controller enables it to remotely control in responding to the cooking condition that the user sets each time during a cooking operation with a remote control. Thus, the cooking is effectively executed with the remote control, while taking into account the cooking conditions set by the user every time according to his taste.

The appliance controller provided with the appliance's modification means, and management system provided with the management's modification means, enable them to modify initially established series of the control by cutting into it. Therefore, the user can interrupt and restart the cooking, and also alter the cooking time.

The appliance controller is provided with the appliance's second storage means, and the management system is provided with the management's second storage means, for accumulating and storing the respective modified information. Since the appliance control system and the management system are able to use the modified information repeatedly, the modified information are freely utilized at any time when repeating an interruption and restarting of the cooking. Also, the information altered by the user can be stored in a memory in the management system for use at any time.

The appliance controller is provided with the appliance's learning function means, and the management system is provided with the management's learning function means. In the appliance control system, the appliance's learning function means stores the more preferable cooking information in the appliance's storage means based on the frequency of use of the cooking information stored in the appliance's storage means and the modified information stored in the appliance's second storage means. Also in the same manner, the management's learning function means in the management system stores the more preferable cooking information in the management's storage means. With a coordinated function of the above process between the appliance control system and the management system, the both can retain the more preferable cooking information of the same recipe. If cooking is carried out by the appliance alone according to the more preferable cooking information, in this instance, it can be processed faster than if it is done via the management system, as a matter of course, so as to effectively reduce a controlling load on the management system.

The appliance controller is provided with the appliance's cooking time setting means, and the management system is provided with the management's cooking time setting means. They have the effect of remarkably improving convenience of use, since the cooking can be started or finished at a time most desirable to the user by enabling it to start or finish the cooking with a remote control at the time set by the user with the appliance's cooking time setting means.

The appliance controller is provided with the appliance's forced termination means, and the management system with the management's forced termination means. Accordingly, they have an effect of preventing an abnormal cooking due to a malfunction in the remote control, since the cooking is forcibly terminated if a failure occurs in exchanging the information between the appliance control system and the management system through the communication pathway.

A personal computer is adopted for all the functions of the appliance controller except for the appliance's reading means, and it is operated as the appliance controller by coupling between the appliance's reading means connected to the communication pathway and the personal computer with the transmission and reception means in a wireless communication. This enables the widely available personal computer to effectively control the heating means.

Since the localized cooking system can control cooking zones of the object to be heated according to a cooking information furnished via the communication pathway, it can realize an error-free cooking of a box lunch in a very short period of time, if the cooking information is arranged to be input automatically to the appliance's control means 30 in advance.

Also, since the cooking information such as an arrangement of food materials in the box lunch, a cooking time, a cooking appliance data, etc. are always renewed according to the program even if a kinds of the box lunch changes frequently in a convenience store and the like, the user is able to cook only the predetermined food materials by simply placing the box lunch, thereby providing the cooking appliance that is remarkably easy to use.

Because the attachment restricts a position for placing the object to be heated within the cooking chamber 27, the object 26 to be heated is always placed in the center area. This enables the localized cooking to finish cooking of each food zone in the same temperature at all times, thereby realizing a uniform cooking of the food materials according to the cooking information of the object to be heated.

The detecting means are provided for detecting a heating progress of the object being heated or an operating condition. Also, the appliance control system and the management system are each provided with the history storage means for storing a history of the detected results. A proper cooking can be realized at all the time, since the history information are communicated by the appliance's control means and the management's control means of each system.

Also, a cooking history of the object to be heated can be stored, since the heating progress of the object being heated and the operating condition are stored in each of the history storage means, and the history information are communicated by the control means of each system. The systems can thus promptly cope with a sanitary control of the objects to be heated, a prevention of food poisoning, and a failure estimation and maintenance of the appliance.

The POS terminal is able to handle the sales management and a new order of the objects to be heated, and to also control the appliance control system at the same time, thereby enabling a quick response with customers.

Since the appliance control system has a function of controlling a plurality of cooking appliances, it can tactfully execute the cooking operation even in a congested lunch hour, by either displaying or informing of a selected heating means available for the cooking.

Since the appliance control system has the function of controlling a plurality of cooking appliances, it can keeps a food in a ready-to-serve condition at all times. Furthermore, it has an effect of facilitating a storage of the cooked objects by either displaying or informing a series of the cooking information for the object to be heated with the appliance's display means or the appliance's notification means.

Since the management system and the appliance control system receive an information through a medium such as a public communication pathway, a television, satellite broadcasting, a surface wave, and the like, and store the information in their respective memory means, the information is promptly renewed and stored in the case of a massive chain of convenience stores. Also, the information is quickly renewed and stored by using the widely available Internet or the satellite broadcasting, even in the case of convenience stores spreading all over the world.

The management system and the appliance control system are each provided with the security means for communicating an information between them. They have an effect of achieving a secure communication of the information by making it difficult for a hacker to interfere or intercept the communication, or to destroy the information, during the communication.

Since the management system and the appliance control system are each provided with the backup means, there is no disability of the control due to a failure in the communication pathway. Also, they can effectively and accurately control the cooking history information at all times by having them communicate with the management system after restoration.

Since the management system is provided with a billing means, it can provide an effect for the management side to reduce a burden of collecting fees, if it offers an information suited for the needs of the customer, and settles the fees by using an electronic banking system or the similar means.

What is claimed is:

1. A cooking appliance comprising:

an appliance control system for cooking food; and a management system coupled to said appliance control system via a communication pathway for remotely controlling the cooking of said food;

said appliance control system comprising:

1) a heating space;

2) heating means for cooking said food placed in said heating space;

3) heating progression detecting means for detecting physical change of said food; and 4) an appliance controller comprising i) appliance's reading means for reading information transmitted from said communication pathway and ii) appliance's control means for processing the information, and, said management system comprising:

5) management's reading means for reading the information transmitted from said communication pathway; and 6) management's control means for processing the information, wherein, said appliance control system transmits to said appliance control system via said communication pathway (a) cooking information for controlling said heating means correspondingly to a cooking recipe selected by a user and (b) information corresponding to physical changes of said food, and, controls said heating means by receiving (c) information for remotely controlling the cooking from said management system via said communication pathway, and said management system transmits to said appliance control system via said communication pathway the remote control information based on said cooking information and said information corresponding to physical changes of said food received via said communication pathway, so as to cook said food under the remote control of said management system while exchanging the information bidirectionally between said appliance control system and said management system via said communication pathway.

2. The cooking appliance according to claim 1, wherein said appliance control system further comprises an appliance's storage means within said appliance controller, and said management system further comprises a management's storage means, and wherein said appliance's storage means stores said information received from said management system, and said management's storage means stores said information received from said appliance control system.

3. The cooking appliance according to claim 2, wherein said appliance control system further comprises an appliance's digital recording medium with in said appliance controller, and said management system further comprises a management's digital recording medium, and wherein said appliance control system is remotely controlled of the cooking by said management system by way of transmitting to said management system (a) the cooking information corresponding to said cooking recipe selected by said user and that is read among the cooking information previously stored in said appliance's digital recording medium, together with (b) the information of physical changes of said food, and said appliance control system receives new cooking information originally recorded in said management's digital recording medium, and stores the information in said appliance's storage means.

4. The cooking appliance according to claim 1, wherein said appliance control system further comprises at least one of an appliance's display means and an appliance's notification means within said appliance controller, and said management system further comprises at least one of a management's display means and a management's notification means, and wherein the cooking information and the information corresponding to physical changes of said food are displayed and/or announced respectively.

5. The cooking appliance according to claim 1, wherein said management system further comprises a sequential operation controller for executing instructions due at a time in response to requirements set by the user during the cooking.

6. The cooking appliance according to claim 1, wherein said appliance control system further comprises an appliance's modification means within said appliance controller, and said management system further comprises a mage-ment's modification means, and wherein said appliance control system and said management system execute a modification requirement by interrupting cooking when the user inputs a command requiring a modification of the initially established cooking information.

7. The cooking appliance according to claim 6, wherein said appliance control system further comprises an appliance's second storage means within said appliance controller, and said management system further comprises a management's second storage means, and wherein said appliance's second storage means stores modified information of said appliance's modification means, and said management's second storage means stores modified information of said management's modification means.

8. The cooking appliance according to claim 7, wherein said appliance control system further comprises an appliance's learning function means within said appliance controller, and said management system further comprises a management's learning function means, and wherein said appliance's learning function means stores a preferable cooking information in said appliance's storage means, based on a frequency of use of the cooking information stored in said appliance's storage means and a frequency of use of the modified information stored in said appliance's second storage means, and said management's learning function means stores said preferable cooking information in said management's storage means, based on a frequency of use of the cooking information stored in said management's storage means and a frequency of use of the modified information stored in said management's second storage means.

9. The cooking appliance according to claim 1, wherein said appliance control system further comprises an appliance's cooking time setting means within said appliance controller, and said management system further comprises a management's cooking time setting means, each for storing at least one of a starting time and an ending time, and wherein the cooking is carried out with a remote control according to at least one of said starting time and said finishing time.

10. The cooking appliance according to claim 1, wherein said appliance control system further comprises an appliance's forced termination means within said appliance controller, and said management system further comprises a management's forced termination means, and wherein the cooking is terminated by said appliance's and management's forced termination means if an abnormality occurs in the cooking.

11. The cooking appliance according to claim 1, wherein said appliance controller is detachable from said appliance control system, and said appliance's reading means and said appliance's control means are coupled with wireless communication.

12. The cooking appliance according to claim 1 further comprising a localized cooking system for locally cooking at least a portion of said food.

13. The cooking appliance according to claim 12, wherein said localized cooking system comprises an attachment for restricting position of said food.

14. The cooking appliance according to claim 12, wherein said appliance control system further comprises a history storage means for storing a history of physical changes of said food.

15. The cooking appliance according to claim 12, wherein said appliance control system further comprises payment means for accomplishing payment.

16. The cooking appliance according to claim 12, wherein said appliance control system controls a plurality of cooking appliances.

17. The cooking appliance according to claim 12, wherein said appliance control system controls a plurality of appliances.

18. The cooking appliance according to claim 12, wherein said management system and said appliance control system further comprise memory means for storing information obtained through a medium including at least one of a public communication line, a television, satellite broadcasting, and a surface wave.

19. The cooking appliance according to claim 12, wherein said management system and said appliance control system further comprise security means for encrypting and decrypting when communicating with each other.

20. The cooking appliance according to claim 12, wherein said management system and said appliance control system further comprise backup means for backing up the cooking information stored in the memory means.

21. The cooking appliance according to claim 12, wherein said management system comprises a billing means for charging a fee when communicating.

22. The cooking appliance according to claim 2, wherein said appliance control system further comprises at least one of an appliance's display means and an appliance's notification means within said appliance controller, and said management system further comprises at least one of a management's display means and a management's notification means, and wherein the cooking information and the information corresponding to physical changes of said food are displayed and/or announced respectively.

23. The cooking appliance according to claim 3, wherein said appliance control system further comprises at least one of an appliance's display means and an appliance's notification means within said appliance controller, and said management system further comprises at least one of a management's display means and a management's notification means, and wherein the cooking information and the information corresponding to physical changes of said food are displayed and/or announced respectively.

24. The cooking appliance according to claim 13, wherein said appliance control system further comprises a history storage means for storing a history of physical changes of said food.

25. The cooking appliance according to claim 13, wherein said appliance control system further comprises payment means for accomplishing payment amount.

26. The cooking appliance according to claim 13, wherein said appliance control system controls a plurality of cooking appliances.

27. The cooking appliance according to claim 13, wherein said appliance control system controls a plurality of appliances.

28. The cooking appliance according to claim 13, wherein said management system and said appliance control system further comprise memory means for storing information obtained through a medium, including at least one of a public communication line, a television, satellite broadcasting, and a surface wave.

29. The cooking appliance according to claim 13, wherein said management system and said appliance control system further comprise security means for encrypting and decrypting when communicating with each other.

30. The cooking appliance according to claim 13, wherein said management system and said appliance control system further comprise backup means for backing up the cooking information stored in the memory means.

31. The cooking appliance according to claim 13, wherein said management system comprises a billing means for charging a fee when communicating.

* * * * *

UNITED STATES PATENT AND TRADEMARK OFFICE

CERTIFICATE OF CORRECTION

PATENT NO. : 6,137,095
DATED : October 24, 2000
INVENTOR(S) : Kashimoto et al.

It is certified that error appears in the above-identified patent and that said Letters Patent is hereby corrected as shown below:

Column 24,
Line 17, delete "appliance control" and insert -- management --.
Line 46, delete "with in" and insert -- within --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*